US006304022B1

(12) United States Patent
Matsutani

(10) Patent No.: US 6,304,022 B1
(45) Date of Patent: Oct. 16, 2001

(54) SPARK PLUG

(75) Inventor: Wataru Matsutani, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/231,556

(22) Filed: Jan. 14, 1999

(30) Foreign Application Priority Data

Jan. 19, 1998 (JP) ..... 10-022853

(51) Int. Cl.[7] ..... H01T 13/20
(52) U.S. Cl. ..... 313/141; 313/118; 445/1
(58) Field of Search ..... 313/118–143; 445/7

(56) References Cited

U.S. PATENT DOCUMENTS

| | | | | |
|---|---|---|---|---|
| 4,540,910 | * | 9/1985 | Kondo et al. | 313/11.5 |
| 4,581,558 | * | 4/1986 | Takamura et al. | 313/141 |
| 4,670,684 | * | 6/1987 | Kagawa et al. | 313/141 |
| 4,743,793 | | 5/1988 | Toya et al. | 313/141 |
| 4,786,267 | * | 11/1988 | Toya et al. | 445/7 |
| 5,990,602 | * | 11/1999 | Katoh et al. | 313/141 |
| 6,121,719 | * | 9/2000 | Matsutani et al. | 313/141 |

FOREIGN PATENT DOCUMENTS

| | | |
|---|---|---|
| 61-124082 | 6/1986 | (JP) . |
| 61-237385 | 10/1986 | (JP) . |
| 62-88287 | 4/1987 | (JP) . |
| 62-226592 | 5/1987 | (JP) . |
| 61-124083 | 6/1989 | (JP) . |
| 3-176978 | 7/1991 | (JP) . |
| 8-37082 | 2/1996 | (JP) . |
| 8-45643 | 2/1996 | (JP) . |

* cited by examiner

*Primary Examiner*—Michael H. Day
*Assistant Examiner*—Matthew J. Gerike
(74) *Attorney, Agent, or Firm*—Brinks Hofer Gilson & Lione

(57) ABSTRACT

A spark plug includes a center electrode, an insulator provided outside the center electrode, a metallic shell provided outside the insulator, a ground electrode disposed to face the center electrode, and a spark discharge portion fixed on at least one of the center electrode and the ground electrode for defining a spark discharge gap. The spark discharge portion is formed from a noble metal alloy containing a main component element selected from among Ir, Pt, and Rh, and at least one additional component element differing from the main component element. In the noble metal alloy, the additional component element is distributed such that stripes of high concentration regions and low concentration regions extend in a direction perpendicular to the direction of voltage application.

24 Claims, 16 Drawing Sheets

SPARK PLUG

BACKGROUND OF THE INVENTION

1. Field of the Invention

The present invention relates to a spark plug used in an internal combustion engine.

2. Description of the Related Art

In recent years, there have been proposed many variations of a spark plug in which a noble metal chip containing, as a main component, Pt, Ir, or the like is welded to the tip end of an electrode in order to improve spark consumption resistance.

However, in recent years, the temperature within a combustion chamber has tended to become higher with an improvement in the performance of an internal combustion engine. Also, more and more engines have been equipped with a spark plug having a spark discharge portion projecting into the interior of a combustion chamber in order to improve ignition performance. Under these circumstances, the spark discharge portion of a spark plug is exposed to high temperature, with the result that consumption of the noble metal chip of the spark discharge portion proceeds more readily. This tendency is especially significant in spark plugs using an Ir chip, which is susceptible to oxidation/volatilization at high temperature.

The consumption of such a chip at high temperature is considered to occur as follows. The chip undergoes a sputtering-like phenomenon caused by sparks as well as oxidation/corrosion or oxidation/volatilization, so that grain boundaries become fragile, and detachment of grains proceeds due to action of sparks. In this connection, Laid-Open Japanese Patent Applications Nos. 8-37082 and 8-45643 propose methods in which the microstructure of the noble metal chip is controlled such that flat crystal grains are layered in a direction perpendicular to a spark discharge surface, thereby increasing the length of the path along which corrosion of grain boundaries proceeds. As a result, the detachment of the grains of chip is suppressed. However, corrosion and grain detachment cannot be effectively prevented through mere control of the crystal grain morphology of a noble metal chip.

SUMMARY OF THE INVENTION

An object of the present invention is to provide a spark plug having a spark discharge portion formed through attachment of a noble metal chip, in which durability of the spark discharge portion is improved through control of the alloy structure of the spark discharge portion from a point of view other than crystal grain morphology.

To achieve the above-mentioned object, the spark plug according to the present invention includes a center electrode; an insulator provided outside the center electrode; a metallic shell provided outside the insulator; a ground electrode disposed to face the center electrode; and a spark discharge portion fixed on at least one of the center electrode and the ground electrode for defining a spark discharge gap. To solve the above-mentioned problems, the spark discharge portion is formed from a noble metal alloy containing a main component element selected from among Ir, Pt, and Rh, and at least one additional component element differing from the main component element. In the noble metal alloy, the additional component element is distributed such that stripes of high concentration regions and low concentration regions extend in a direction perpendicular to the direction of voltage application.

The spark discharge portion is formed through welding of a chip made of the above-mentioned noble metal alloy to a ground electrode and/or a center electrode. In the present specification, the "spark discharge portion" denotes a portion of a welded chip that is free from variations in composition caused by welding (i.e. a portion other than the portion of the welded chip which has alloyed with a material of the ground electrode or center electrode due to welding).

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which:

FIGS. 14A and 14B are two-dimensional mapping outputs obtained through EPMA surface analysis performed on a cross section of the alloy that forms the spark discharge portions of a spark plug of the Example, wherein FIG. 14A shows the distribution of concentration of Ir-characteristic X-ray, while FIG. 14B shows the distribution of concentration of Rh-characteristic X-ray;

DETAILED DESCRIPTION OF THE PREFERRED AND ALTERNATE EMBODIMENTS

Figure 1:
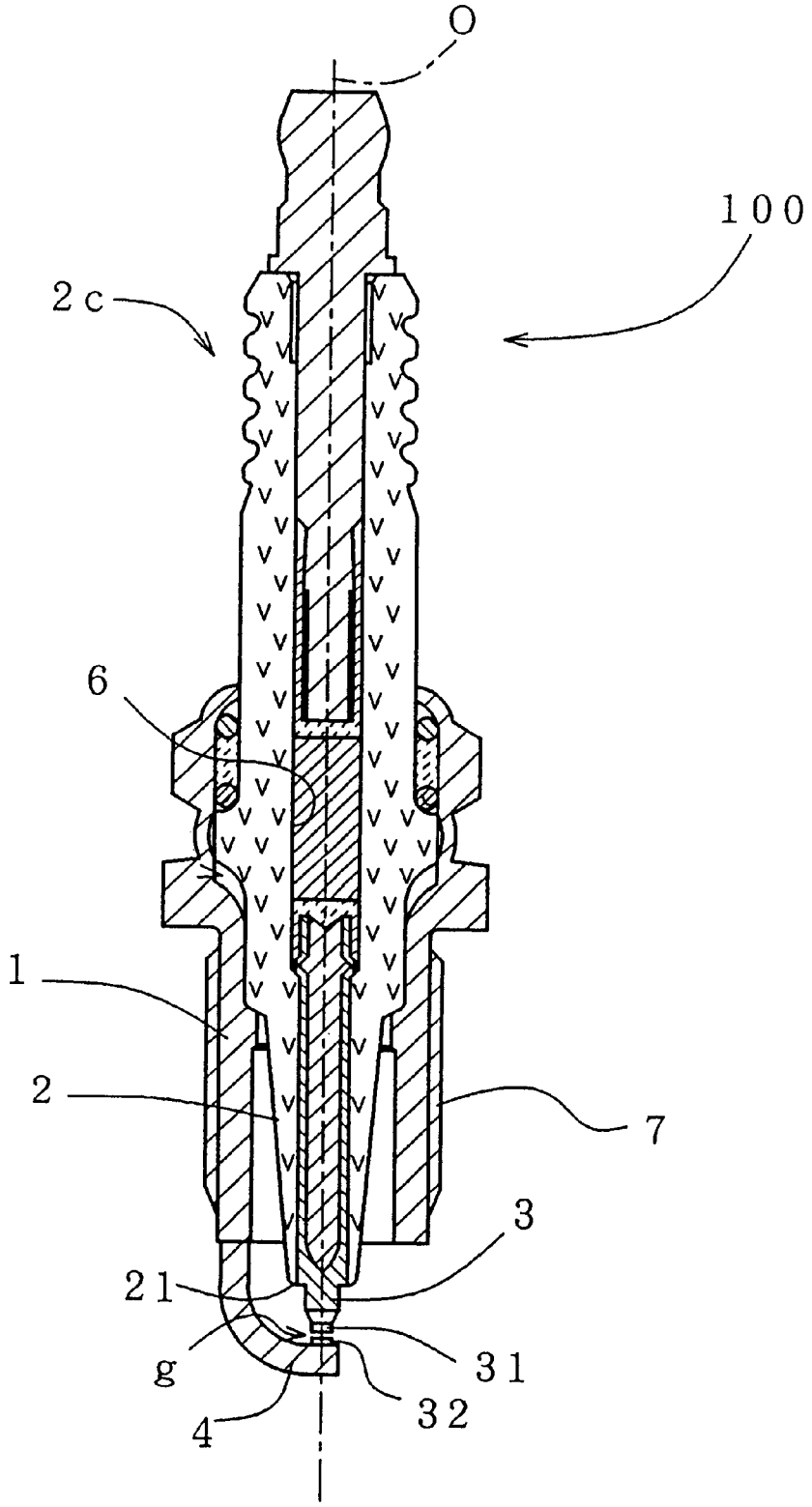
FIG. 1 is a cross-sectional view of a spark plug according to the present invention.

The present inventors conducted careful studies and found that in the case where an additional component element is distributed within a noble metal alloy constituting a spark discharge portion such that stripes of high concentration regions and low concentration regions are formed, if the spark discharge portion is formed such that the stripes of high concentration regions and low concentration regions extend in a direction intersecting (for example, at a substantially right angle) the direction of application of voltage, i.e., the direction of electric discharge at the spark discharge portion, consumption of the spark discharge portion is efficiently suppressed to a high degree, to thereby realize a spark plug having excellent durability. The present invention has been achieved based on this finding.

In the present invention, the expression "additional component phase region" denotes a region having a concentration of the additional component element not lower than a mean concentration of the additional component element in the entire alloy. Likewise, the expression "main component phase region" denotes a region having a concentration of the additional component element lower than a mean concentration of the additional component element in the entire alloy. In this case, the noble metal alloy may have a structure as follows: main component phase regions and additional component phase regions are layered in the voltage application direction at the spark discharge portion; each of the main component phase regions being mainly formed of the aforementioned main component element; and each of the additional component phase regions containing the additional component element in an amount greater than that in the main component phase regions, and the main component element in an amount 97% or less that in the main component phase regions.

Next, there will be described the reason why the consumption resistance of the spark discharge portion is improved through the above-described control of the structure of the alloy that constitutes the spark discharge portion.

Alloy composition differs between the main component phase region and the additional component phase region, and their corrosion potentials at high temperature are considered to differ from each other. Therefore, a local cell is conceivably formed at the portion where the boundary between the main component and additional component phase regions is exposed to high temperature gas, which is a corrosional environment, so that corrosion is accelerated by short-circuit current generated by the local cell.

In the case where the above-mentioned regions are layered, if the direction of layering is made substantially identical to the spark discharge direction, there is decreased the area of the region boundaries exposed at the electric discharge surface (spark discharge surface) which is most easily consumed among the surfaces of the spark discharge portion. Consequently, this structure suppresses the corrosion of the spark discharge portion, due to the formation of a local cell. Further, detachment of the grains due to grain boundary corrosion is suppressed, resulting in improved durability of the spark discharge portion.

The structure of each of the main component regions and the additional component regions within the alloy is not required to relate to the structure or morphology of crystal grains that constitute the alloy. For example, some regions may be flat, aggregated grain regions each formed of a large number of aggregated crystal grains and layered on one another.

Specifically, the above-described spark plug may be formed as follows:

(A) One end of a ground electrode is connected to a metal shell, and the other end is bent toward a center electrode such that one side surface of the ground electrode faces the tip end surface of the center electrode. A spark discharge portion is provided on the tip end surface of the center electrode and/or the side surface of the ground electrode facing the tip end surface of the center electrode. The spark discharge portion has a structure in which flat, main component phase regions and flat, additional component phase regions are layered in the axial direction of the center electrode. In this structure, a spark discharge surface is formed on the spark discharge portion to extend in a direction substantially perpendicular to the axis of the center electrode. This structure effectively suppresses consumption of the spark discharge surface.

(B) A spark discharge portion is fixed to the tip end surface of the center electrode. One end of the ground electrode is connected to the metal shell, and the other end is bent toward the center electrode such that the tip end surface of the ground electrode faces the side surface of the center electrode. The spark discharge portion has a structure in which flat, main component phase regions and flat, additional component phase regions are layered in a direction substantially perpendicular to the axis of the center electrode. In this structure, a spark discharge surface is formed on the side surface of the spark discharge portion fixed to the center electrode. This structure effectively suppresses consumption of the spark discharge surface.

In the present specification, "flat" denotes a shape whose maximum dimension in the direction of layering is smaller than the maximum dimension measured perpendicular to the direction of layering. Each of the main component phase regions and the additional component phase regions may be formed into the shape of a plate. Alternatively, each of the regions may be formed into the shape of a rod or a fiber drawn in one direction.

As the additional component, there may be used at least one element selected from among Rh, Pt, Ir, Pd, Re, Ru, Nb, Os, and W, so long as the element is different from the main component element. For example, when a spark discharge portion is formed from an alloy which contains Ir as a main component and to which at least one element selected from among Rh, Pt, Pd, Re, Ru, Nb, Os, and W is added, the main component element is Ir, and the additional component element is at least one element selected from among Rh, Pt, Pd, Re, Ru, Nb, Os, and W. More specifically, when the alloy forming the spark discharge is an Ir—Rh binary alloy which contains Ir as a main component and Rh as an additional component, the main component element is Ir and the additional component element is Rh. Likewise, when the alloy forming the spark discharge is an Ir—Rh—Pt ternary alloy which contains Ir as a main component and Rh and Pt as additional components, the main component element is Ir and the additional component elements are Rh and Pt.

The following alloys can be used as the alloy which contains Ir as a main component and which forms the spark discharge portion, provided that the additional component phase regions of the present invention are formed in the alloys.

(1) An alloy that contains Ir (main component) and Rh (at least 3 wt. % but less than 50 wt. %). Use of this alloy effectively suppresses consumption of the spark discharge portion stemming from oxidation/volatilization of the Ir component at high temperature, so that a spark plug having excellent durability is realized.

When the Rh content of the alloy is less than 3 wt. %, the effect of suppressing oxidation/volatilization of Ir becomes insufficient, so that the spark discharge portion comes to be easily consumed, resulting in deteriorated durability of the spark plug. When the Rh content of the alloy is 50 wt. % or higher the melting point of the alloy decreases, resulting in deteriorated durability of the spark plug. In view of the above, the Rh content is adjusted within the above-mentioned range, preferably within a range of 7 to 30 wt. %, more preferably within a range of 15 to 25 wt. %, most preferably within a range of 18 to 22 wt. %.

(2) An alloy that contains Ir (main component) and Pt (1 to 20 wt. %). Use of this alloy effectively suppresses consumption of the spark discharge portion stemming from oxidation/volatilization of the Ir component at high temperature, so that a spark plug having excellent durability is realized. When the Pt content of the alloy is less than 1 wt. %, the effect of suppressing oxidation/volatilization of Ir becomes insufficient, so that the spark discharge portion comes to be easily consumed, resulting in deteriorated durability of the spark plug. When the Pt content of the alloy is 20 wt. % or higher, the melting point of the alloy decreases, resulting in deterioration in the durability of the spark plug.

(3) An alloy that contains Ir (main component), Pt (1 to 20 wt. %), and Rh (1 to 49 wt. %). Use of this alloy effectively suppresses consumption of the spark discharge portion stemming from oxidation/volatilization of the Ir component at high temperature. In addition, workability of the alloy is drastically improved through adjustment of the Rh content within the above-mentioned range. Consequently, there is realized a spark plug having excellent durability (especially durability in high-speed driving) and being well-suited to mass productivity.

When the Rh content of the alloy is less than 1 wt. %, the effect of improving workability of the alloy becomes insufficient, so that fractures or cracks occur easily, resulting in decreased yield of material in production of chips to be formed into spark discharge portions. In the case where chips are produced through hot punching or a like method, a tool such as a punching blade becomes susceptible to consumption or damage, resulting in lowered efficiency of production. When the Rh content of the alloy is greater than 49 wt. % the melting point of the alloy decreases, resulting in deteriorated durability of the spark plug. In view of the above, the Rh content is adjusted within the above-mentioned range, preferably within a range of 2 to 20 wt. %.

Especially when the total content of Rh and/or Pt is 5 wt. % or less, the alloy becomes fragile. Therefore, Rh content lower than a predetermined value leads to difficulty in production of chips through machining. In this case, Rh is added in an amount of 2 wt. % or more, preferably 5 wt. % or more, more preferably 10 wt. % or more. In some cases where the Rh content is 3 wt. % or more, addition of Rh not only improves workability, but also efficiently suppresses oxidation/volatilization of the Ir component at high temperature.

When the Pt content of the alloy is less than 1 wt. % the effect of suppressing oxidation/volatilization of Ir becomes insufficient, so that the spark discharge portion comes to be easily consumed, resulting in deteriorated durability of the spark plug. When the Pt content of the alloy is 20 wt. % or more the melting point of the alloy decreases, resulting in deteriorated durability of the spark plug. Also, in view of the high cost of Pt, when the Pt content is 20% or more, the effect of suppressing consumption of the spark discharge portion is not enhanced to a level commensurate to an increase in costs of chip material. In view of the above, the Pt content is adjusted within the above-mentioned range, preferably within a range of 3 to 20 wt. %.

(4) In the case where an Ir—Rh—Pt alloy is used the following alloy composition is effectively employed, in order to decrease the content of expensive Pt and that of Rh while effectively suppressing consumption stemming from the oxidation/volatilization of the Ir component: Ir (main component); Rh: 0.2 to 10 wt. %; Pt: 10 wt. % or less; and WPt/WRh: 0.1 to 1.5, wherein WPt is the Pt content (wt. %) and WRh is the Rh content (wt. %).

In other words, the alloy is characterized in that the Pt content is no more than 1.5 times the Rh content. That is, when the Pt content is set in the above-described manner, sufficient consumption resistance of the spark discharge portion can be secured even if the Rh content is considerably decreased as compared with the case of a conventional spark plug using an Ir—Rh binary alloy. Therefore, a high-performance spark plug can be produced at lower cost. In this case, if the composition of this alloy is determined to fall within the same range as that of the alloy (3), the effect of improving workability of the alloy is also attained.

When the Rh content of the alloy is greater than 10 wt. %, the contribution of added Pt to the effect of suppressing the oxidation/volatilization of Ir becomes insignificant. Therefore, superiority of the spark plug using this alloy over a conventional spark plug using an Ir—Rh binary alloy is not secured. When the Rh content of the alloy is less than 0.2 wt. % the effect of suppressing oxidation/volatilization of Ir becomes insufficient, so that the spark discharge portion comes to be easily consumed, resulting in failure to secure the consumption resistance of the spark plug.

The effect of added Pt to the suppression of the oxidation/volatilization of Ir becomes more significant with decreasing Rh content. In this case, even if the Rh content is 8 wt. % or less, addition of Pt can significantly suppress the oxidation/volatilization of Ir at the spark discharge portion and can improve the corrosion resistance of the spark discharge portion, despite the lowered Rh content. As a result, the superiority of the spark plug using this alloy over a conventional spark plug using an Ir—Rh binary alloy is magnified. Therefore, the Rh content is adjusted within the above-mentioned range, preferably within a range of 0.2 to 3 wt. %, more preferably 0.5 to 2 wt. %.

When the Pt content of the alloy is greater than 10 wt. %, the effect of suppressing oxidation/volatilization of Ir becomes insufficient, so that the spark discharge portion comes to be easily consumed, resulting in failure to secure the consumption resistance of the spark plug. The ratio of WPt/WRh is adjusted to 1.5 or less, wherein WPt is the Pt content and WRh is the Rh content. When WPt/WRh is greater than 1.5, the effect of suppressing oxidation/volatilization of Ir may be rather impaired, as compared with the case where no Pt is added. When WPt/WRh is less than 0.1, there is expected substantially no contribution of added Pt to the effect of suppressing the oxidation/volatilization of Ir. Therefore, WPt/WRh is preferably adjusted within a range of 0.2 to 1.0 wt. %.

The above description indicates that a preferable range of WPt (the Pt content of the material for forming the spark discharge portion) depends on WRh (the Rh content of the same). For example, when WRh is 1 wt. %, WPt preferably falls within the range of 0.1 to 1.5 wt. %. Also, when WRh is 2 wt. %, WPt preferably falls within the range of 0.2 to 3 wt. %. Further, when WRh is 3 wt. %, WPt preferably falls within the range of 0.3 to 4.5 wt. %. Furthermore, when WRh is 4 wt. %, WPt preferably falls within the range of 0.4 to 6 wt. %.

(5) An alloy that contains Ir (main component), Rh (0.1 to 35 wt. %), and Ru (0.1 to 17 wt. %). Use of this alloy effectively suppresses consumption of the spark discharge portion stemming from oxidation/volatilization of the Ir component at high temperature, so that a spark plug having excellent durability is realized. When the Rh content of the alloy is less than 0.1 wt. %, the effect of suppressing oxidation/volatilization of Ir becomes insufficient, so that the spark discharge portion comes to be easily consumed, resulting in failure to secure the corrosion resistance of the spark plug. When the Rh content of the alloy is greater than 35 wt. %, the melting point of the alloy decreases, resulting in deteriorated consumption resistance of the spark plug. As a result, durability of the spark plug is not secured. Therefore, the Rh content is adjusted within the above-described range.

When the Ru content is less than 0.1 wt. %, the effect of added Ru to the suppression of oxidation/volatilization of Ir becomes insufficient. When the Ru content exceeds 17 wt. %, consumption of the spark discharge portion due to sparking adversely becomes easy to proceed as compared with the case where no Ru is added, resulting in failure to secure sufficient durability of the spark plug. Therefore, the Ru content is adjusted within the above-described range, preferably within a range of 0.1 to 13 wt. %, more preferably within a range of 0.5 to 10 wt. %.

One of the reason why the consumption resistance of the spark discharge portion is improved through incorporation of Ru into the alloy is presumed to be as follows. Through addition of Ru, a dense oxide film that is stable at high temperature is formed on the surface of the alloy, so that Ir—which is highly volatile when an oxide is formed from Ir only—is fixed within the oxide film. This oxide film conceivably functions as a passive-state film, to thereby suppress progress of oxidation of the Ir component. In a state where no Rh is added to the alloy, the resistance of the alloy to oxidation/volatilization at high temperature is not improved very much even if Ru is added to the alloy. Therefore, it is considered that the above-described oxide film is a composite oxide film of e.g., an Ir—Ru—Rh system, which is superior to an Ir—Ru system oxide film in terms of density and close contact to the alloy surface.

When the Ru content is excessive, consumption of the spark discharge portion is presumed to proceed due to the following mechanism rather than evaporation of Ir oxide. That is, when the Ru content is excessive, there decreases the denseness of the oxide film or the degree of closeness of contact to the alloy surface. This adverse effect becomes remarkable when the Ru content exceeds 17 wt. %. Further, when impact of spark discharge of the spark plug repeatedly acts on the oxide film, the oxide film peels off so that a fresh metal surface thereunder is exposed. As a result, consumption of the spark discharge portion due to sparking becomes easy to proceed.

Further, the addition of Ru achieves the following important effect. That is, when Ru is added into the alloy, even if the Rh content is considerably reduced, a higher degree of consumption resistance can be secured as compared with the case where an Ir—Rh binary alloy is used. Thus, high-performance spark plugs can be manufactured at lower cost. The Rh content is preferably set within a range of 0.1 to 3 wt. %.

The alloys (1)–(5) described above may contain an oxide (including a composite oxide) of a metallic element of group 3A (so-called rare earth elements) or 4A (Ti, Zr, and Hf) of the periodic table in an amount of 0.1 wt. % to 15 wt. %. The addition of such an oxide more effectively suppresses consumption of Ir stemming from oxidation/volatilization of Ir. When the oxide content is less than 0.1 wt. %, the effect of added oxide against oxidation/volatilization of Ir is not sufficiently achieved. By contrast, when the oxide content is greater than 15 wt. %, the thermal shock resistance of a chip is impaired; consequently, the chip may crack, for example, when the chip is fixed to an electrode through welding or the like. Preferred examples of the oxide include $Y_2O_3$ as well as $La_2O_3$, $ThO_2$, and $ZrO_2$.

Next will be described embodiments of the present invention with reference to the drawings.

As shown in FIGS. 1 and 2, a spark plug 100, which serves as an embodiment of the present invention, includes a cylindrical metallic shell 1, an insulator 2, a center electrode 3, and a ground electrode 4. The insulator 2 is inserted into the metallic shell 1 such that a tip portion 21 of the insulator 2 projects from the metallic shell 1. The center electrode 3 is fittingly provided in the insulator 2 such that a spark discharge portion 31 formed at a tip end of the center electrode 3 projects from the insulator 2. One end of the ground electrode 4 is connected to the metallic shell 1 by welding or a like method, and the other end of the ground electrode 4 is bent toward the center electrode 3 such that the side surface of the ground electrode 4 faces the tip of the center electrode 3. A spark discharge portion 32 is formed on the ground electrode 4 so as to face the spark discharge portion 31. The spark discharge portions 31 and 32 define a spark discharge gap g therebetween.

The insulator 2 is formed from a sintered body of ceramics such as alumina ceramics or aluminum-nitride ceramics and has an axial hollow portion 6 formed therein for receiving the center electrode 3. The metallic shell 1 is tubularly formed from metal such as low carbon steel and has threads 7 formed on the outer circumferential surface that are used for mounting the spark plug 100 to an engine block (not shown).

In this structure, either of the spark discharge portions 31 or 32 may be omitted. In such a case, a spark discharge gap g is defined between the spark discharge portion 31 and the ground electrode 4, or between the spark discharge portion 32 and the center electrode 3.

Figure 2A:
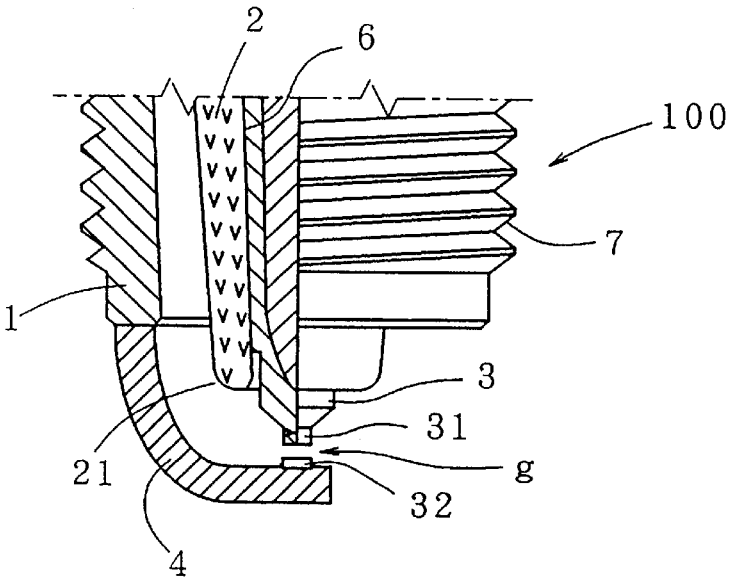
FIG. 2A is a partial, cross-sectional view of the spark plug of FIG. 1.
Figure 2B:
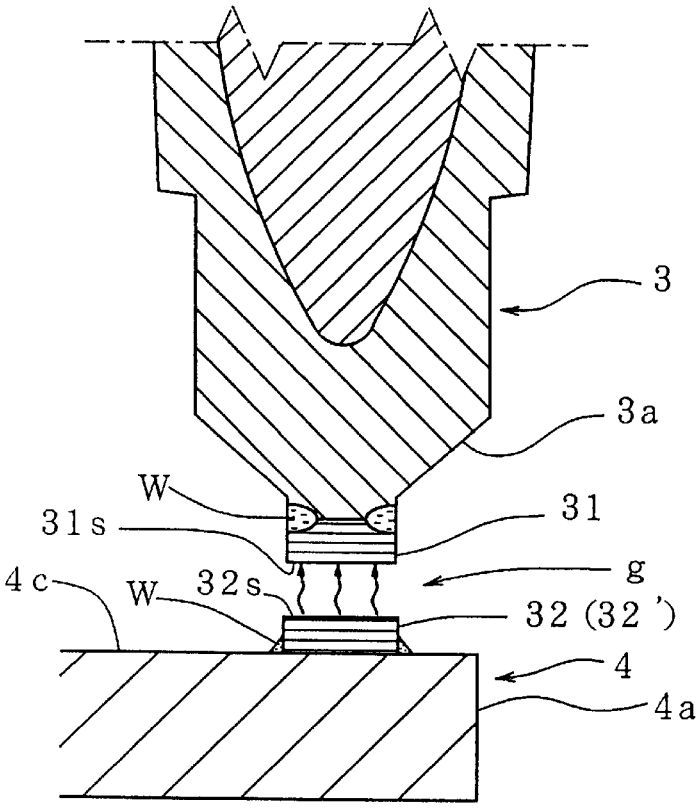
FIG. 2B is an enlarged, cross-sectional view of a main portion of the spark plug of FIG. 1.

As shown in FIG. 2B, a body portion 3*a* of the center electrode 3 and a body portion 4*a* of the ground electrode 4 are formed from an Ni alloy or a like alloy. In contrast, the spark discharge portion 31 and the spark discharge portion 32 facing the spark discharge portion 31 are formed from a noble alloy containing a main component element selected from among Ir, Pt, and Rh, and at least one additional component element selected from among Rh, Pt, Pd, Re, Ru, Nb, Os, and W, such that the additional component element (s) differ from the main component element. The noble alloy has a structure shown schematically in FIG. 3. Flat main component phase regions and flat additional component phase regions are layered in the direction of voltage application at the spark discharge surface 31 (in the direction parallel to the axis O of the center electrode 3 in FIG. 1); each of the main component phase regions is mainly formed of the aforementioned main component element; and each of the additional component phase regions contains the additional component element in an amount greater than that in the main component phase regions, and the main component element in an amount that is 97% or less that in the main component phase regions.

Figure 3:
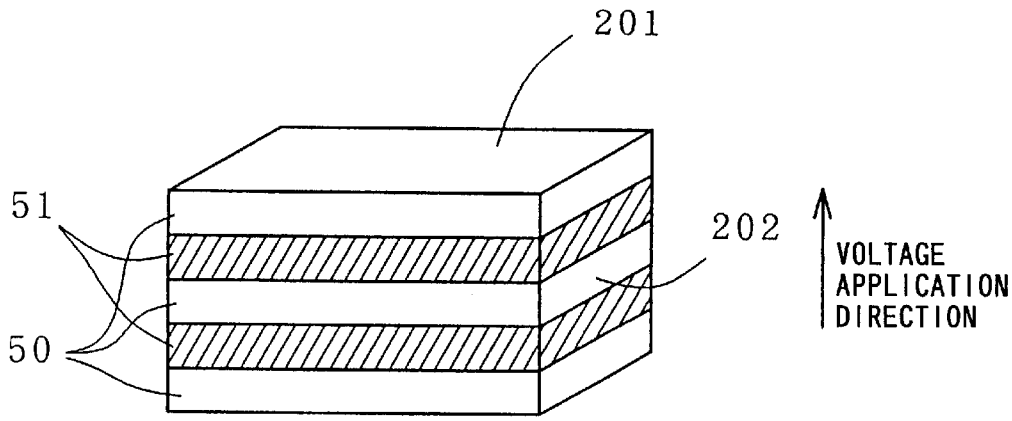
FIG. 3 is a schematic view showing the structure of an alloy forming a spark discharge portion of the spark plug of FIG. 1.

Next will be more specifically described alloys which can be used as the above-mentioned noble alloy, which is entirely in a solid solution state at temperature higher than a critical temperature and melts and causes phase separation at the critical temperature or lower. Of these alloys, alloys usable for forming the spark discharge portion of the present invention include Ir—Rh, Ir—Pt, Pt—Rh, and Ir—Pt—Rh alloys. In the present embodiment, reference is made to an example in which the spark discharge portions 31 and 32 are formed of an Ir—Pt—Rh ternary alloy, such as an alloy containing Ir as a main component, Pt in the amount of 1 to 20 wt. % (preferably 5 to 20 wt. %), and Rh in the amount of 1 to 49 wt. % (preferably 2 to 20 wt. %). In FIG. 3, main component phase regions 50 are phase regions in which Ir is contained as a main component and the remainder is substantially made up of Rh and Pt, and additional component phase regions 51 are phase regions in which the average content of Rh and the average content of Pt are higher than those in the main component phase regions and the average content of Ir is 90% or less that in the main component phase regions. Disk-shaped chips for forming such spark discharge portions 31 and 32 may be produced as follows.

Figure 5:
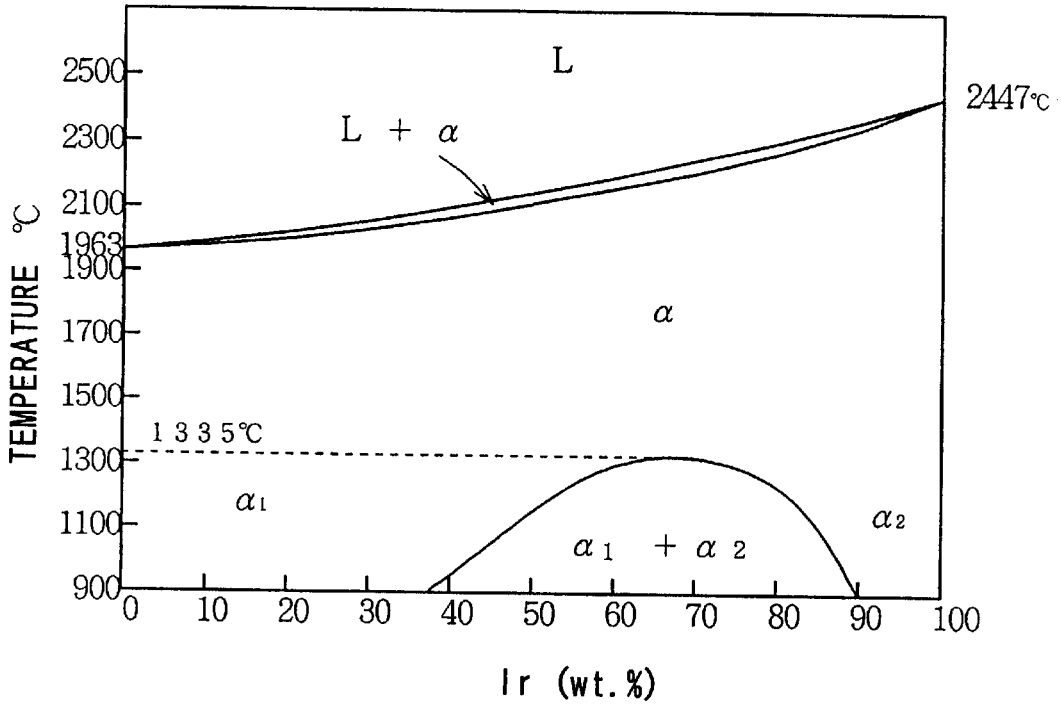
FIG. 5 is a phase diagram of Ir—Rh binary alloy.

Elemental metals of Ir, Pt, and Rh serving as raw materials are mixed at a predetermined ratio and melted in order to produce an alloy ingot. Referring to FIG. 5, which is a phase diagram of an Ir—Rh binary alloy, the critical temperature is 1335° C., and, at temperatures not greater than 1335° C., phase separation to Rh-rich phase $\alpha 1$ and Ir-rich phase $\alpha 2$ occurs in the alloy. Ir—Pt and Rh—Pt alloys also exhibit such phase separation. With regard to the composition containing Ir as a main component, phase separation is presumed to proceed in such a manner that Rh-rich phase and/or Pt-rich phase is precipitated in Ir-rich phase during the process of cooling (spinodal decomposition may proceed depending on the composition).

Figure 6A:
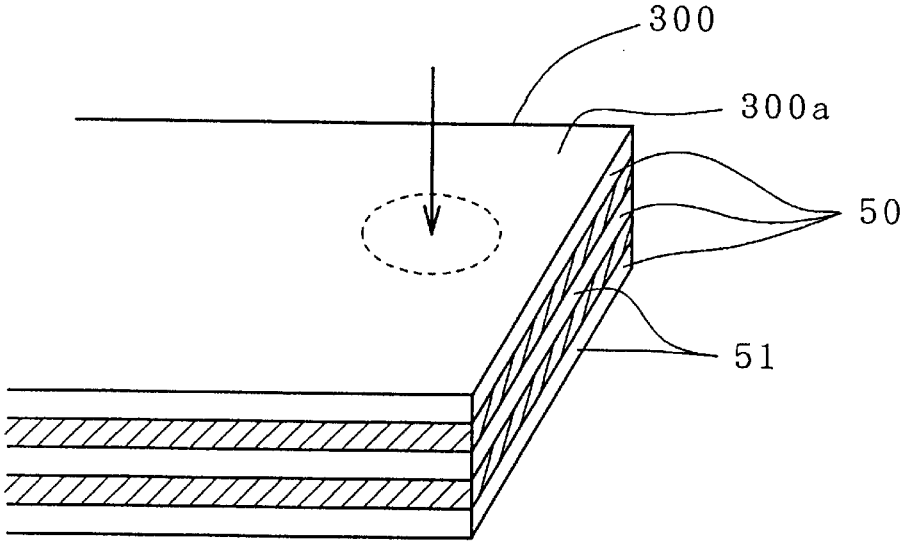
FIGS. 6A and 6B are explanatory views showing a method of producing chips for forming spark discharge portions.
Figure 6B:
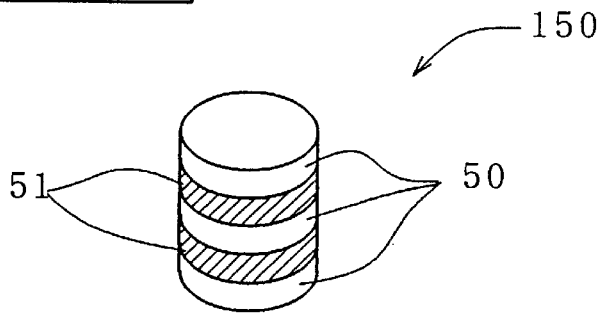

When the alloy ingot is heated to about 700° C. and hot rolled into a plate 300 as shown in FIGS. 6A and 6B, the plate 300 has a layered structure composed of main component phase regions 50 each formed mainly of the Ir-rich phase, and additional component phase regions 51 each containing the Rh-rich phase and/or the Pt-rich phase at a ratio higher than that in the main component phase regions 50.

The present inventor investigated the distribution of Ir concentration in a cross section of a chip formed from an alloy having the composition of Ir—Rh(5 wt. %)-Pt(5 wt. %), through EPMA (electronic probe micro analysis) conducted by use of an SEM (scanning electron microscope) (the results are shown in FIG. 14). As a result, the inventor found that the main component phase regions 50 had an Ir content of about 92 wt. % (the remainder: Rh and Pt), and that the additional component phase regions 51 had an Ir content of about 88 wt. % (about 96% the Ir content of the main component phase regions). Each of the main component phase regions 50 and the additional component phase regions 51 is presumed to have the following structure: a solid solution phase containing Rh as a main component with the remainder made up substantially of Ir and Pt (hereinafter called "Rh-rich phase"), and a solid solution phase containing Pt as a main component with the remainder made up substantially of Ir and Rh (hereinafter called "Pt-rich phase") became dispersed, in the form of fine precipitates, in a solid solution phase containing Ir as a main component with the remainder made up of Pt and Rh (hereinafter called "Ir-rich phase"). In this case, the concentration of Rh-rich phase precipitates and the concentration of Pt-rich phase precipitates in the main component phase region 50 are higher than those in the additional component phase region 51, thus producing a difference in mean Ir content between the regions 50 and 51.

From the phase diagram, the difference in Ir content between the Ir-rich phase and the Rh-rich phase or the difference in Ir content between the Ir-rich phase and the Pt-rich phase is presumed to be 50 wt. % or more. These phases having differences in concentrations corresponding to the differences in Ir content could not be visually observed in the analysis of a cross section through the EPMA even when the magnification was increased to as high as 1000 times. Therefore, assuming that the precipitates of the Rh-rich phase and Pt-rich phase are generated, each of the precipitates is presumably in the form of fine particles having a grain size of 1 $\mu$m or less.

The plate 300 is punched through hot punching or cut through electric discharging machining into a disk, to thereby obtain a chip 150 having a layered structure in which the main component phase regions 50 and the additional component phase regions 51 are layered in the axial direction of the disk-shaped chip.

As shown in FIG. 2B, the body 3*a* of the center electrode 3 has a tip end portion whose diameter decreases toward the flat tip end surface thereof. The disk-shaped chip 150 (FIG. 6B) is placed on the tip end surface of the center electrode 3. Subsequently, a weld zone W is formed along the boundary between the chip and the tip end portion through laser welding, electron beam welding, resistance welding, or a like welding method, thereby fixedly attaching the chip onto the tip end portion and forming the spark discharge portion 31. Likewise, the chip 150 (FIG. 6B) is placed on the ground electrode 4 in a position corresponding to the spark discharge portion 31; thereafter, the weld zone W is formed along the boundary between the chip and the ground electrode 4 so as to attach the chip fixedly onto the ground electrode 4, to thereby form the spark discharge portion 32.

Next, the action of the spark plug 100 will be described.

The spark plug 100 is mounted to an engine block by means of the threads 7 and is used as an igniter for an air-fuel mixture fed into a combustion chamber. The spark discharge portions 31 and 32 which define a spark discharge gap g are formed from an alloy having a structure as follows: a great number of main component phase regions and additional component phase regions are layered in the direction of the voltage application, i.e., in the direction parallel to the axis of the center electrode 3. With this structure, consumption of the spark discharge portions 31 and 32 is suppressed effectively, to thereby realize a spark plug having excellent durability.

Figure 2C:
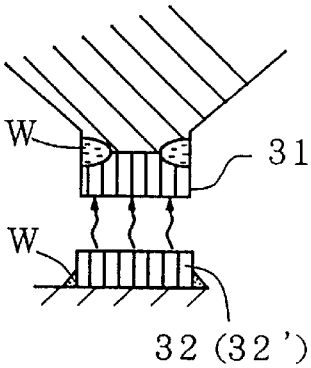
FIG. 2C is an enlarged, cross-sectional view of a comparative example.
Figure 4:
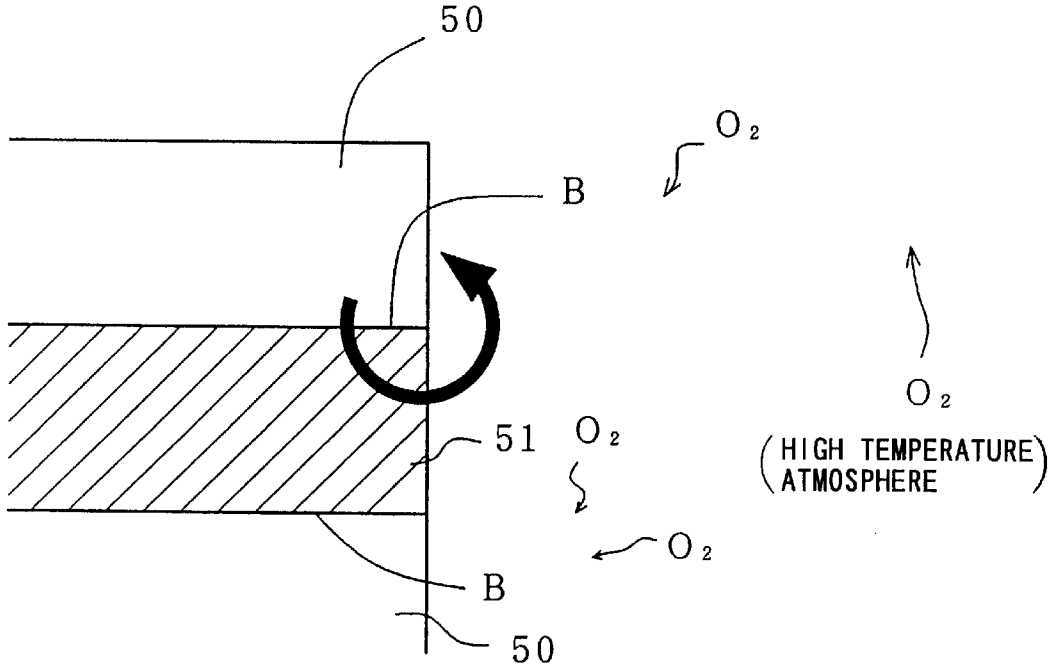
FIG. 4 is an explanatory view showing a mechanism of corrosion in the structure of the alloy.

The reason why consumption resistance of the spark discharge portions 31 and that of the spark discharge portion 32 are improved is presumed to be as follows. In the main component phase regions 50 having an Ir content higher than that in the additional component phase regions 51, oxidation/volatilization of Ir readily proceeds in a high-temperature atmosphere containing oxygen. As a result, as shown in FIG. 4, at a portion where a boundary B between the regions 50 and 51 is exposed there is formed a local cell whose cathode is formed in the main component phase region 50 and whose anode is formed in the additional component phase region 51. The local cell generates a short-circuit current which is considered to accelerate corrosion. However, in the present embodiment, the regions 50 and 51 are layered in a direction substantially the same as that of spark discharge. Therefore, as shown in FIG. 2B, there can be decreased the area of the boundaries B exposed at electric discharge (spark discharge) surfaces 31*s* and 32*s* which are consumed most easily among the surfaces of the spark discharge portions 31 and 32. In this structure, the corrosion of the spark discharge portions 31 and 32 due to the formation of a local cell proceeds less readily than in the case of a structure in which the spark discharge portions 31 and 32 are disposed with an orientation as shown in FIG. 2C. Consequently, detachment of grains due to corrosion of grain boundaries is suppressed, resulting in improved durability of the spark discharge portions 31 and 32.

Figure 8A:
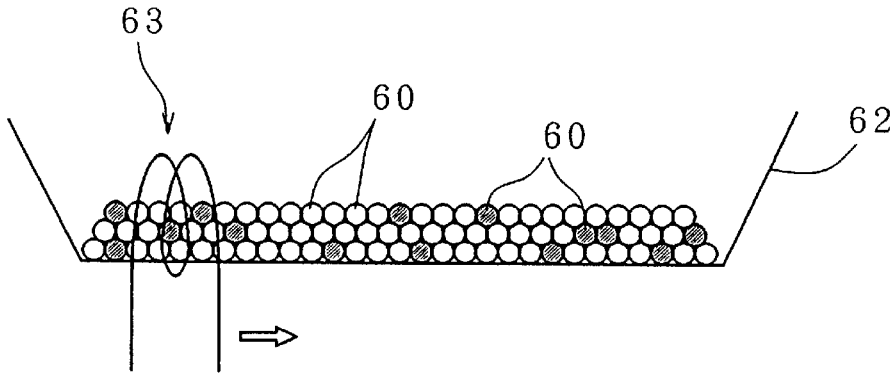
FIGS. 8A, 8B and 8C are explanatory views showing a method of producing an alloy ingot used as a material of the chips.
Figure 8B:
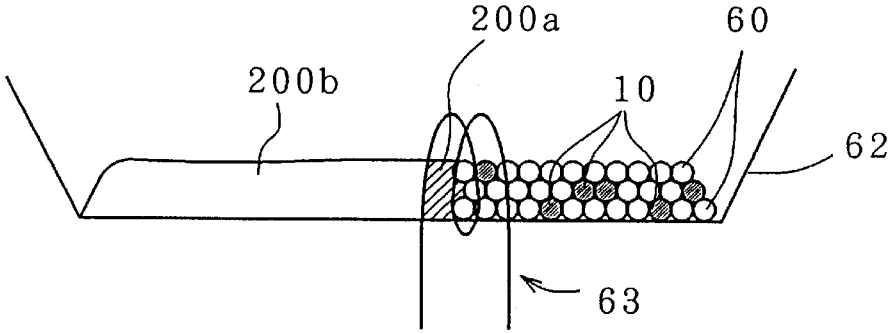

The reason why hot rolling produces the above-mentioned layered structure in the plate 300 (FIG. 6A) is presumed to be as follows. Since Ir, Pt, and Rh serving as alloy materials are all noble metals having a very high melting point, the alloy is advantageously produced under a small-lot production method, which will be described below. As shown in FIG. 8A, the respective metallic materials 60 are mixed in a refractory container 62 in order to obtain a desired composition; the mixture is locally melted by use of a heat source 63 such as an induction heating coil (or a laser beam, a plasma arc beam, or a like beam); and a melted region 200*a* of the mixture slowly moves with the local heat source 63 in a predetermined direction as shown in FIG. 8B so as to heat the entirety of the mixture. In order to obtain a homogeneous alloy, the above-mentioned melting process is preferably repeated a plurality of times.

Figure 8C:
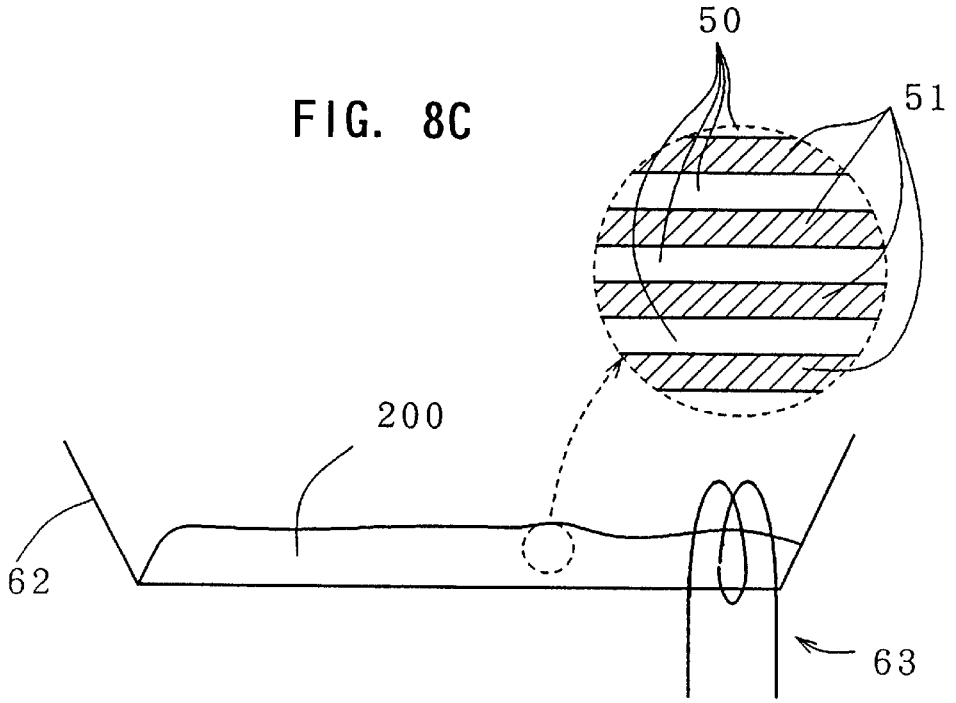

Since the melted region 200*a* is directionally cooled due to presence of an already-solidified portion 200*b*, Rh-rich phase and/or Pt-rich phase is conceivably likely to precipitate in the direction of cooling. As a result, as shown in FIG. 8C, the thus-obtained alloy ingot 200 attains a layered (or rod-shaped) structure in which each additional component phase region 51 containing the Rh-rich phase and/or the Pt-rich phase at a higher ratio extends between the main component phase regions 50 in the direction of movement of the heat source 63.

Figure 9:
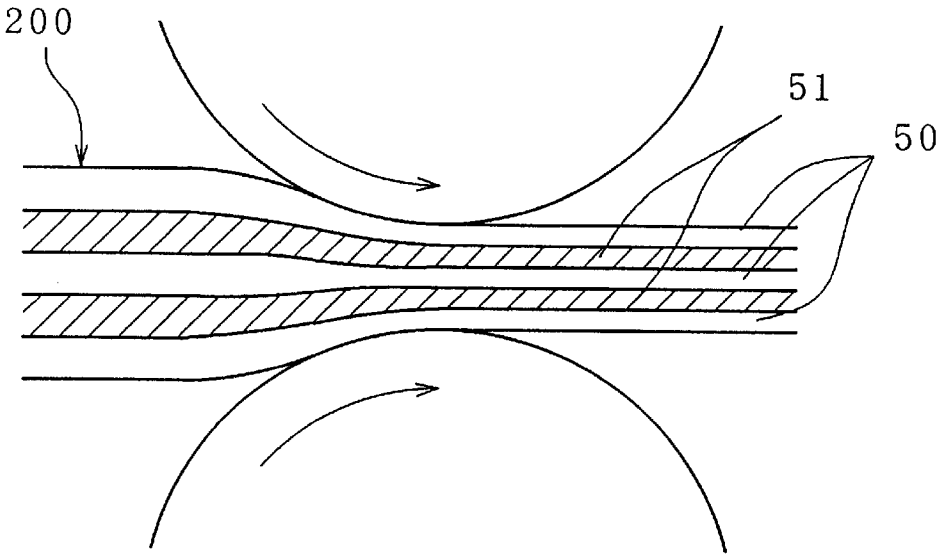
FIG. 9 is an explanatory view showing a process of producing an alloy plate used for production of the chips.

As shown in FIG. 9, the ingot 200 is hot rolled at least once (for example, at about 700° C.) in such a manner that pressure is applied in the direction of layering of the additional component phase regions 51 and the main component phase regions 50, so that the thickness of the ingot 200 is reduced, to thereby obtain a plate 300. In this process, since the layered structure composed of the additional component phase regions 51 and the main component phase regions 50 is considered to be maintained although the thickness thereof is reduced, the plate 300 is presumed to have a layered structure as shown in FIGS. 6A and 6B.

Figure 10:
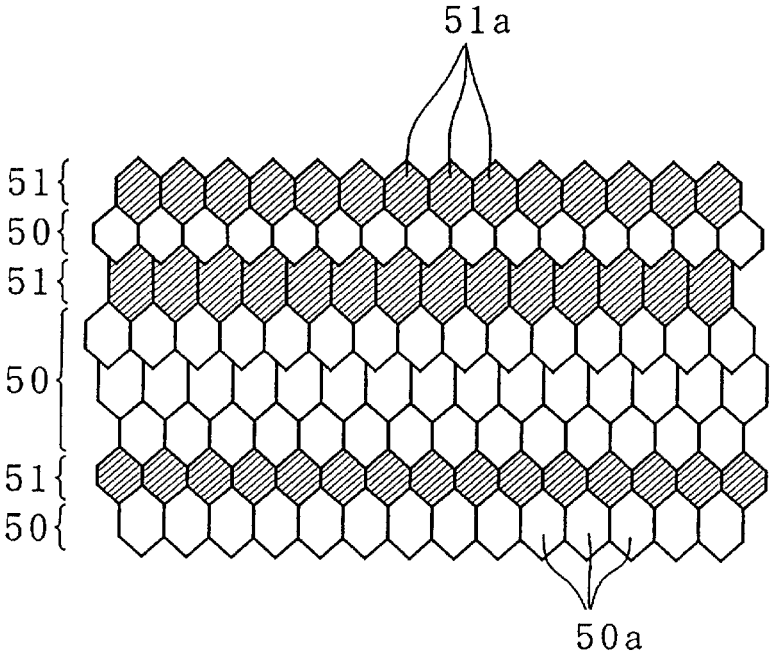
FIG. 10 is an enlarged schematic view showing the structure of an alloy forming the spark discharge portions.

Before being subjected to hot rolling, the crystal grains in the alloy ingot 200 are considered to have a shape elongated in the extending direction of the additional component phase regions 51 and the main component phase regions 50, due to the above-described directional cooling. However, when subjected to hot rolling in the above-mentioned temperature range, such crystal grains may become fine crystal grains, because of dynamic recrystallization. However, since the above-mentioned hot rolling temperature is much lower than a temperature at which the alloy is brought into a single-phase state, the layered structure composed of the regions 51 and the regions 50 is very likely to be maintained at least partially, regardless of the conversion into fine crystal grains. As a result, there may be formed a structure as shown in FIG. 10, in which some of the regions 50 and 51 become flat aggregated-grain regions each formed of a great number of aggregated crystal grains 50*a* or 51*a* and layered on one another.

Figure 11A:
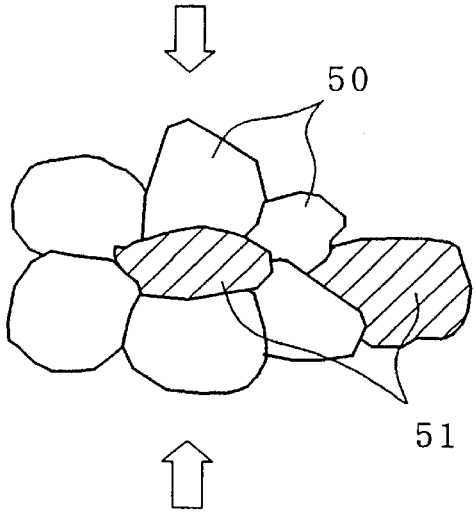
FIGS. 11A and 11B are enlarged schematic views showing a process in which the structure of the alloy is flattened through rolling.
Figure 11B:
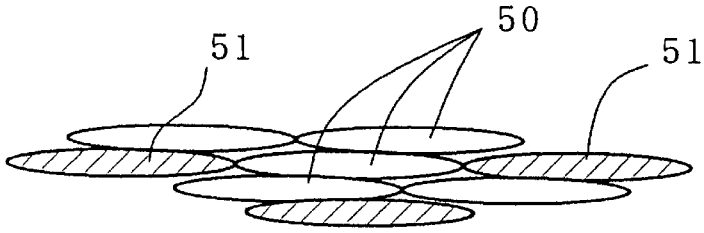

As shown in FIG. 11A, even in the case where the ingot has a structure in which the additional component phase regions 51 and the main component phase regions 50 are not layered, and the ingot has, for example, a structure similar to an equiaxial structure, the crystal grains contained in the ingot are crushed through hot rolling, resulting in the layered structure as shown in FIG. 11B.

Another presumable mechanism is as follows: In cooling after hot rolling or rolling, the Rh-rich phase and/or the Pt-rich phase is precipitated, in the form of layers, in the Ir-rich phase under stress of rolling.

Figure 12:
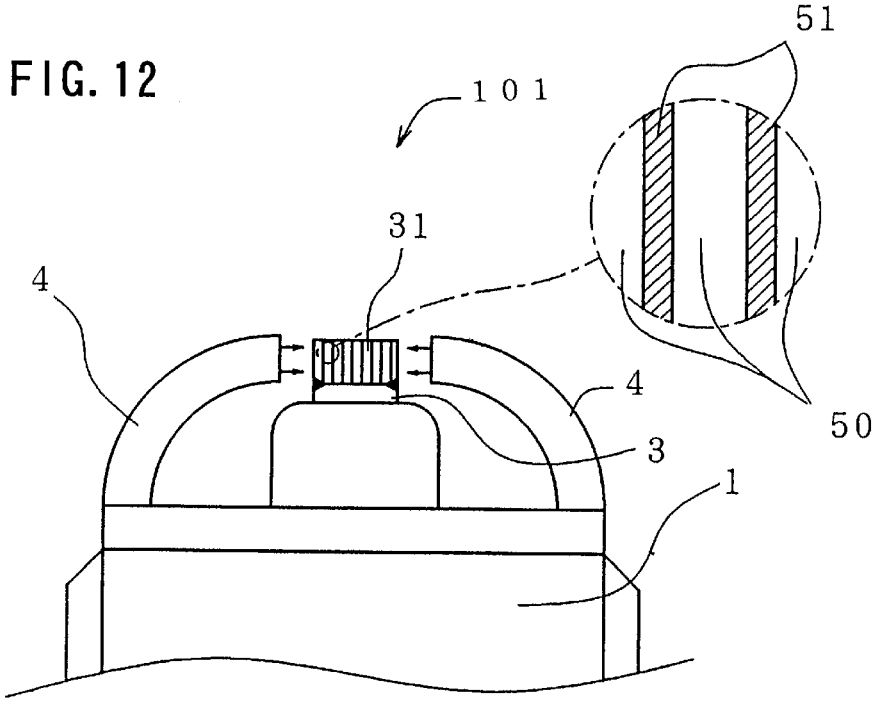
FIG. 12 is a view showing a modification of the spark discharge portion of the spark plug according to the present invention.

The spark plug 101 of the present invention may have a structure as shown in FIG. 12. That is, a chip is fixedly attached to the tip end surface of the center electrode 3 so as to form a spark discharge portion 31; a plurality of ground electrodes 4 are provided; and one end of each of the ground electrodes is connected to the metal shell 1 and the other end thereof is bent toward the center electrode 3 such that the tip end surface of the ground electrode 4 faces the side surface of the spark discharge portion 31. In this structure, the spark discharge portion 31 has a structure in which the main component phase regions 50 and additional component phase regions 51 are layered in a direction substantially perpendicular to the axis of the center electrode 3. With this structure, there is effectively suppressed consumption in the side surface of the spark discharge portion 31 serving as a spark discharge surface.

Figure 7A:
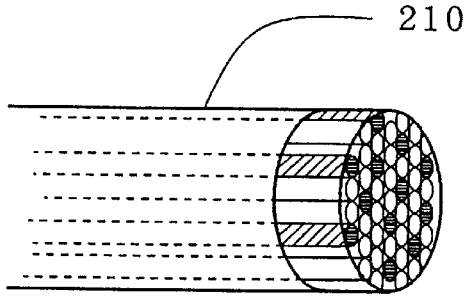
FIGS. 7A and 7B are explanatory views showing a modification of the method shown in FIGS. 6A and 6B.
Figure 7B:
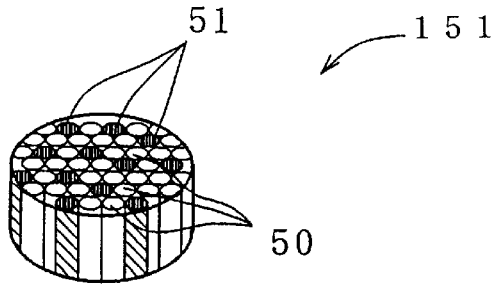

In this case, a chip as shown in FIGS. 7A and 7B may be used to form the spark discharge portion 31. In this chip, the main component phase regions 50 and the additional component phase regions 51 are formed into the shape of a rod or a fiber drawn in one direction (the direction of the axis of the center electrode 3 in (FIG. 12). Such a chip 151 may be produced as follows: the ingot 200 produced by the method as shown in FIG. 8 is machined into a cylindrical rod 210 through hot forging (for example, hot swaging) or a like method; and the rod 210 is cut at predetermined axial intervals to thereby obtain a chip 151 having a predetermined thickness.

EXAMPLES

Predetermined amounts of Ir, Rh, and Pt were mixed and melted, to thereby produce an alloy having a composition of Ir(90 wt. %)—Rh(5 wt. %)—Pt(5 wt. %). The alloy was machined into a plate having a thickness of 0.5 mm through hot rolling at 700° C. Next, the plate was subjected to hot punching (at 700° C. or more), to thereby obtain disk-shaped chips having a diameter of 0.7 mm and a thickness of 0.5 mm (a spark plug of an Example). Meanwhile, the alloy was hot-swaged into a rod at 700° C., and the rod was cut at predetermined axial intervals through electric discharge machining to thereby prepare another group of disk-shaped chips having a thickness of 5 mm (a spark plug of a Comparative Example).

The respective groups of the chips were used to form the spark discharge portion 31 and the spark discharge portion 32 facing the discharge portion 31 (a spark discharge gap g: 1.1 mm) of a spark plug 100 as shown in FIG. 1 and FIG. 2A. The performance of each of the thus-formed spark plugs was tested in a 6-cylinder gasoline engine (piston displacement: 2000 cc) under the following conditions: throttle completely open, engine speed 5000 rpm, and 600-hour continuous operation. During the test operation, the increase in the spark discharge gap g was measured every hour. The results are shown in FIG. 13.

Figure 13:
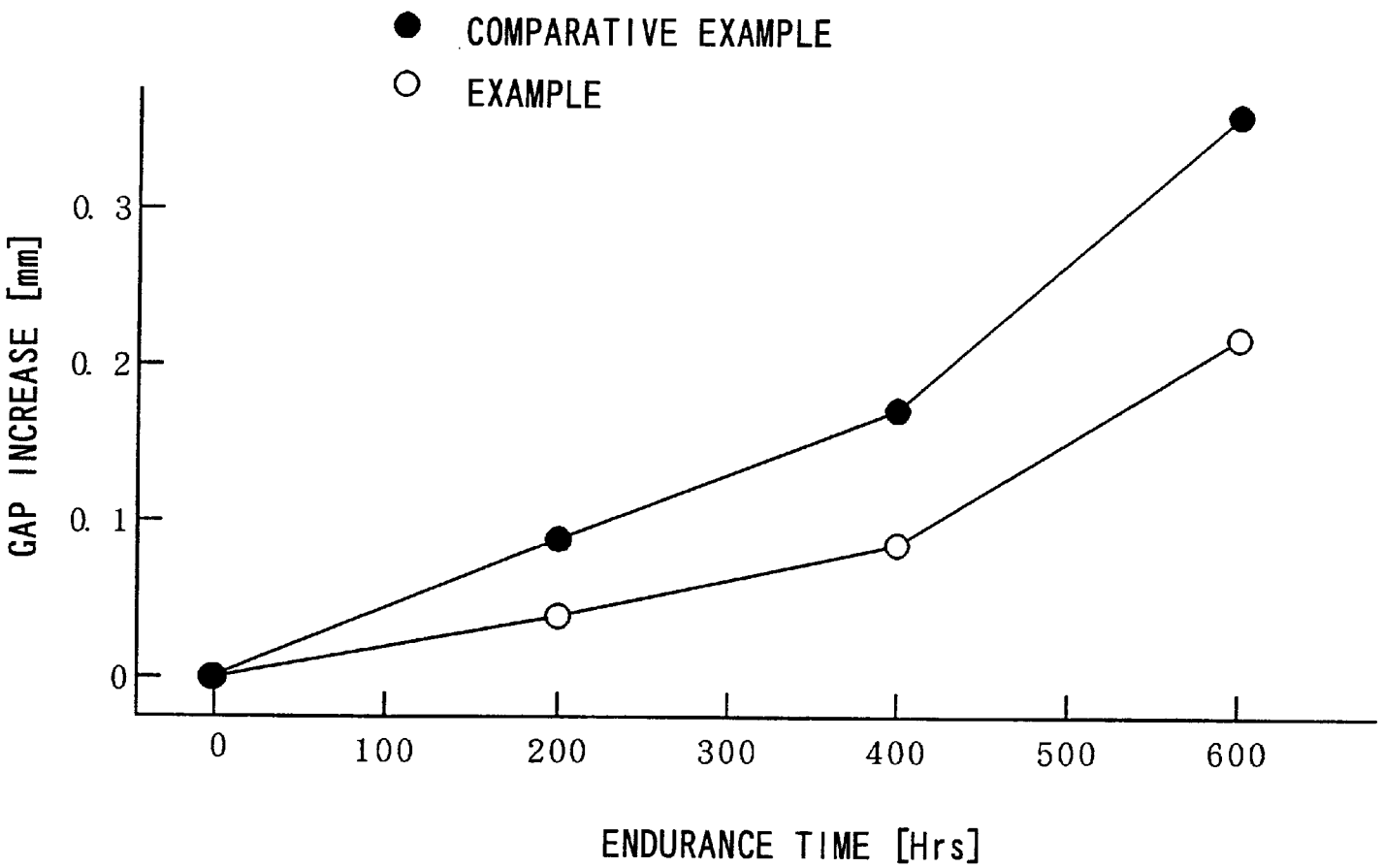
FIG. 13 is a graph showing the results of an experiment on the spark plugs of Example and Comparative Example.

As shown in FIG. 13, in the spark plug of the Comparative Example, the increase in the spark discharge gap g is considerably large. In contrast, in the spark plug of the Example the increase is small, indicating excellent durability.

Figure 14A:
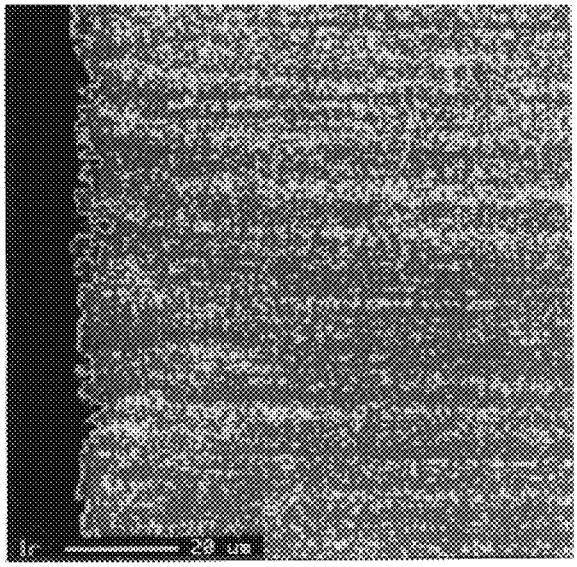
Figure 14B:
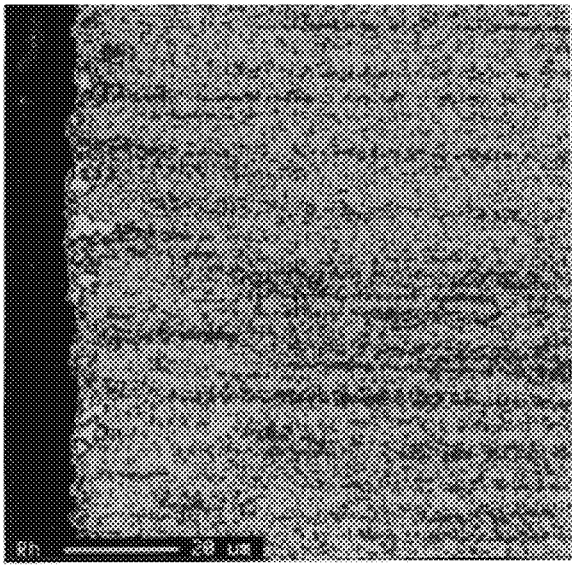

The spark discharge portion 31 of the Example was cut along a plane containing the axis of a center electrode, and the distribution of concentration of Ir and that of Rh in the cross section were measured through EPMA (electronic probe micro analysis) conducted by use of an SEM (scanning electron microscope). FIG. 14A shows the output of two-dimensional mapping that shows the distribution of strength of Ir-characteristic X-ray (darker regions indicate higher concentration of Ir), and FIG. 14B shows that indicating the distribution of strength of Rh-characteristic X-ray (darker regions indicate higher concentration of Rh). In FIGS. 14A and 14B, the arrow denotes the direction of the axis of a center electrode 3, and the electric discharge surface is located on the upper side of the figure.

In FIG. 14A showing the distribution of strength of Ir-characteristic X-ray, there are formed stripes of light and dark layered in the axial direction of the center electrode 3. In contrast, in FIG. 14B, high strength regions of Rh-characteristic X-ray are formed corresponding to low-strength regions of Ir-characteristic X-ray. That is, the spark discharge portion 31 appears to have a structure in which a great number of high Ir-concentration phase regions (main component phase regions) and high Rh-concentration phase regions (additional component phase regions) are layered in the above-mentioned direction. On the basis of the mean strength levels of characteristic X-rays in each of dark and light regions, the compositions of the main component phase regions and the additional component phase regions were calculated. The results of the calculation showed that the main component phase regions had a composition of Ir: about 92 wt. %; Rh: about 3.5 Wt. %; and Pt: about 5.5 wt. %, and that the additional component phase regions had a composition of Ir: about 88 wt. %; Rh: about 6.5 Wt. %; and Pt: about 5.5 wt. %.

Figure 15A:
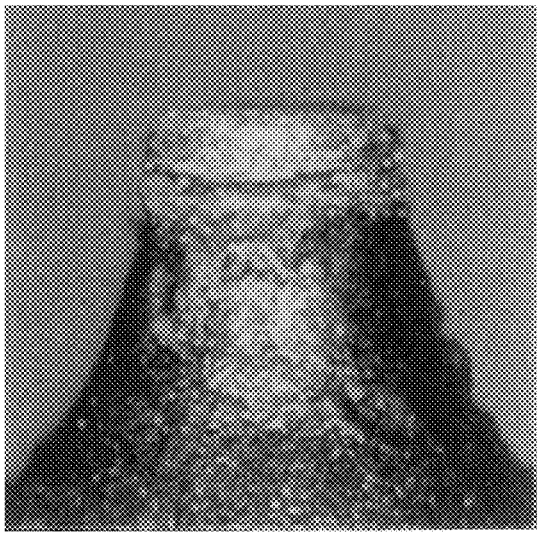
FIG. 15A is a photograph showing the appearance of the spark discharge portion of the spark plug of the Example after a test.
Figure 15B:
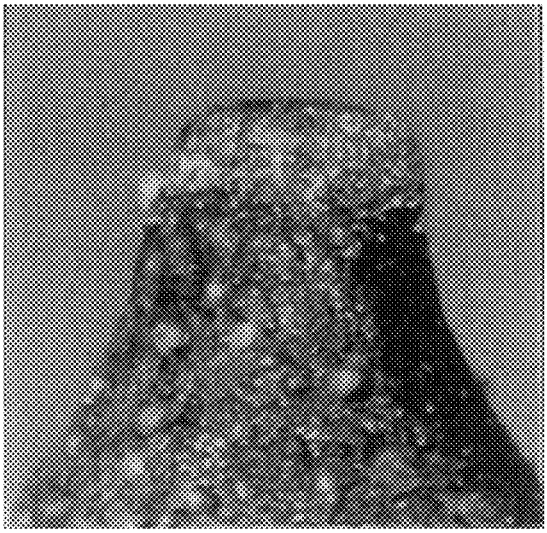
FIG. 15B a photograph showing the appearance of the spark discharge portion of a spark plug of the Comparative Example after the test.

FIG. 15A is a photograph showing the appearance of the spark plug of the Example after the test, and FIG. 15B is that of the spark plug of the Comparative Example after the test. In the spark plug of the Example, consumption of the spark discharge portion appears to have not proceeded much. Presumably, this is because the exposure of the boundaries between the two types of regions at the electric discharge (spark discharge) surface susceptible to consumption is relatively small, and therefore corrosion of the spark discharge portion due to the formation of a local cell does not readily proceed. In contrast, in the spark plug of the Comparative Example, the spark discharge portion has a structure identical with that of the chip 151 shown in FIG. 7B, and therefore a great number of the above-mentioned boundaries are exposed at the surface of an axial end serving as a spark discharge surface, which is presumed to be the reason for rapidly-proceeding corrosion of the spark discharge portion.

Next will be described the spark plug of a Reference Invention. The structure of the Reference Invention may be used in combination with the structure of the spark plug of the present invention, or singly used in a spark plug having no relation with the present invention.

The spark plug of the Reference Invention includes a center electrode, an insulator provided outside the center electrode, a metallic shell provided outside the insulator, a ground electrode disposed to face the center electrode, and a spark discharge portion fixed on at least one of the center electrode and the ground electrode, which together define a spark discharge gap, characterized in that a projection is formed on the surface of the ground electrode facing the center electrode such that the projection projects toward the center electrode, and that a spark discharge portion is fixed to the tip end surface of the projection.

Figure 16A:
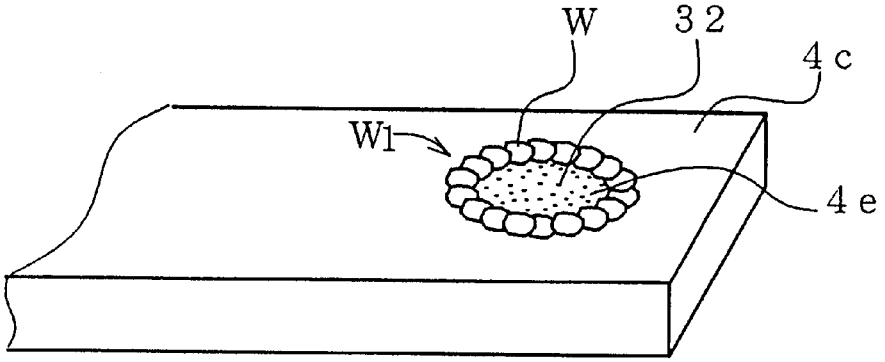
FIGS. 16A and 16B are explanatory views showing another method of forming the spark discharge portion of a ground electrode.
Figure 16B:
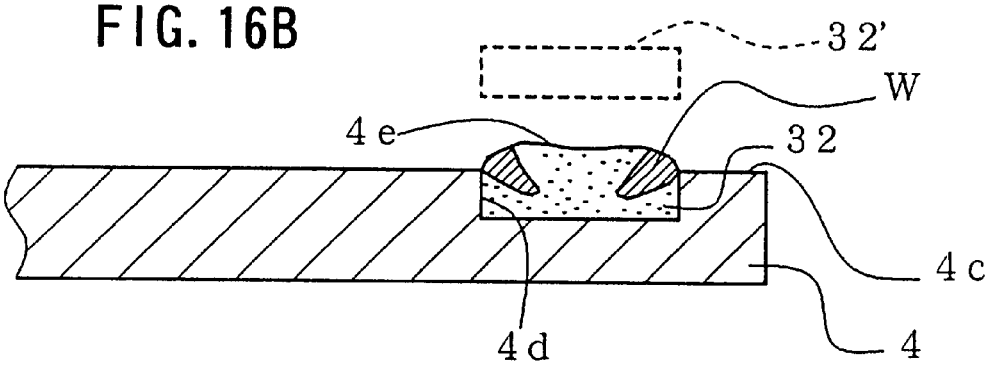
Figure 17:
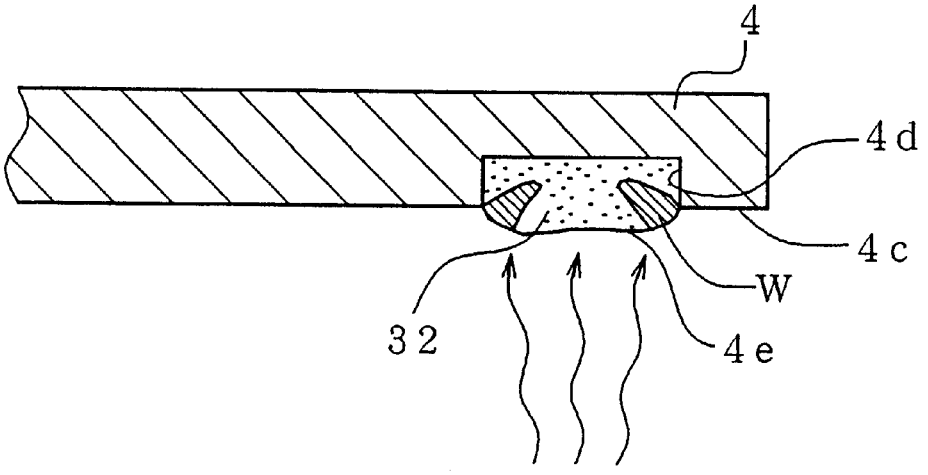
FIG. 17 is an explanatory view showing problems in the spark discharge portion of FIGS. 16A and 16B.

In a spark plug in which a noble metal chip is fixed to a ground electrode so as to form a spark discharge portion, typically either the structure shown in FIG. 2B or the structure shown in FIGS. 16A and 16B is employed. In the structure shown in FIG. 2B, a noble metal chip 32' is directly fixed on the surface 4*c* of a ground electrode 4 facing a center electrode. In the structure shown in FIG. 16B, a chip 32' is disposed in a shallow depression 4*d* formed in the surface 4*c*, and a weld zone W is formed along the peripheral edge of the chip 32' so as to fix the chip 32' to the ground electrode 4. Generally, the weld zone W has a lowered melting point since the metal components of the ground electrode 4 have alloyed with those of the chip 32'. Also, on the surface of the ground electrode 4, the weld zone W is spread outside with respect to the spark discharge portion 32. As a result, the area suffering action of sparks is large, and corrosion proceeds with ease. Further, in the structures as shown in FIGS. 2B and 16B, since the weld zone W exists in the vicinity of an area where sparks are generated by the spark discharge portion 32, under the conditions such as those of a high-speed/heavy-load operating state where a spark plug is exposed to high temperature for a long time, the service life of the spark discharge portion 32 may not be sufficiently maintained.

In recent years, as the exhaust gas control has been further tightened, more and more automobiles have been equipped with lean burn engines. Therefore, spark plugs capable of reliably igniting a lean air-fuel mixture are demanded. In such a spark plug, reduction of the diameter of the tip end of a spark discharge portion is effective in improving ignition performance. In the structure as shown in FIG. 16B, since the chip 32' is buried in the depression 4*d*, the height of projection of the spark discharge portion 32 is small. As a result, the top surface 4*e* of the spark discharge portion 32 becomes substantially flush with the weld zone W, or the weld zone W adversely projects from the top surface 4*e*. Consequently, the surface of the weld zone W facing the center electrode serves substantially as a part of the electric discharge surface. Such a structure is an obstruction in reduction of the diameter of the spark discharge portion, and hence an obstruction in improvement of ignition performance.

Figure 18:
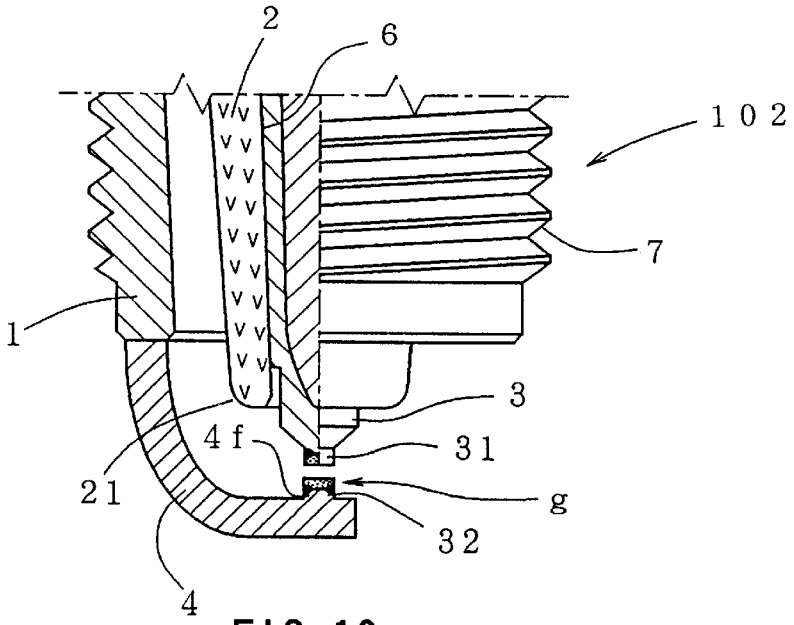
FIG. 18 is a partial, cross-sectional view of an example of the spark plug of the Reference Invention.
Figure 19:
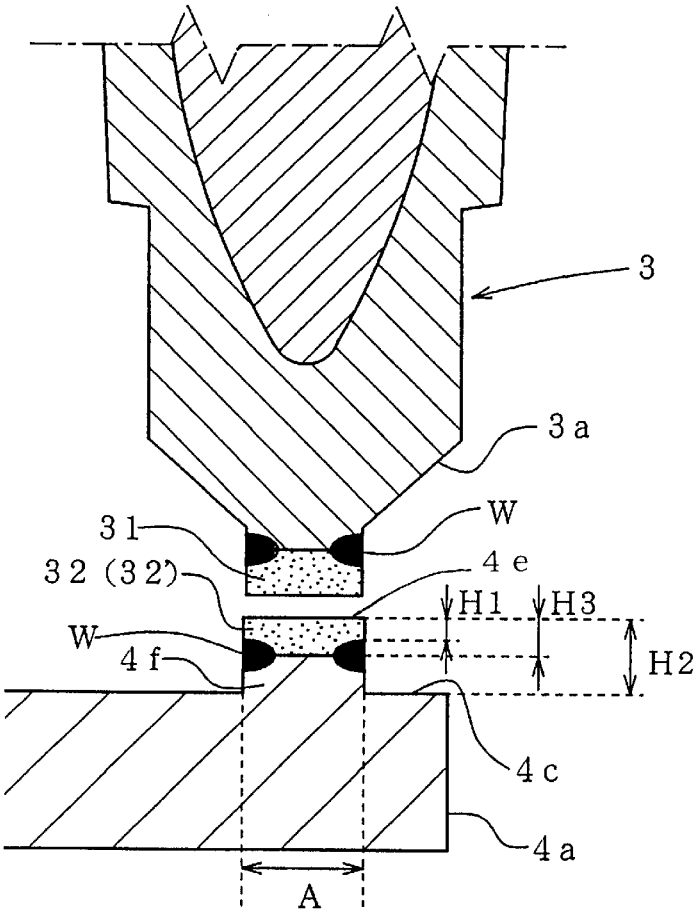
FIG. 19 is an enlarged, cross-sectional view of a main portion of the spark plug of FIG. 18.

The structure of the spark plug according to the Reference Invention solves all the above-mentioned problems. Specifically, as shown in FIGS. 18 and 19, a projection 4*f* (for example, a projection having a circular cross section) is formed on the surface 4*c* of the ground electrode 4 such that the projection 4*f* projects toward the center electrode 3, and a noble metal chip is then fixed via a weld zone W on the tip end surface of the projection 4*f*, to thereby form a spark discharge portion 32. In this case, a weld zone W may be formed along the border between a noble metal chip 32' and the projection 4*f* to thereby bond them together (common portions in FIGS. 1, 2A and 2B are denoted by the same reference numerals, and their descriptions will be omitted).

With this structure, the weld zone W is formed apart form the surface 4*c* of the ground electrode 4 by a distance corresponding to the height of the projection 4*c* so that excess metal produced by welding is prevented from widely spreading on the surface 4*c*. Consequently, the weld zone W becomes less likely to be subjected to action of sparks, resulting in improved durability of the spark discharge portion 32. As shown in FIG. 19, a height H2 from the surface 4*c* to the top surface 4*e* of the spark discharge portion 32 can be sufficiently increased, so that the diameter of the top surface of the spark discharge portion 32 is prevented from increasing due to the presence of the weld zone W. accordingly, when the spark plug is used in a lean-burn engine or the like, the diameter of the spark discharge portion can be reduced so as to improve ignition performance. In addition, since a noble metal chip is fixed on the top of the projection 4*f* so as to form the spark discharge portion, the amount of expensive noble metal can be decreased as compared with a case in which the entire projection on the ground electrode 4 is made of a noble metal chip.

The weld zone W is preferably formed through laser welding in order to increase the bonding strength between the noble metal chip 32' and the projection 4*f*. However, the noble metal chip 32' and the projection 4*f* may be bonded together through resistance welding.

The projection height H2 of the top surface 4*e* of the spark discharge portion 32 from the surface 4*c* is represented by the total of the height of the projection 4*f* and the thickness H3 of the spark discharge portion 32. In this case, the ratio of A/H2 is preferably 2.0 or less, wherein A is the diameter of a cross section intersecting the axis (if the shape of the cross section is not circular, A is the diameter of a circle whose area is the same as that of the cross section). If A/2H is greater than 2.0, the weld zone W is readily spread on the surface 4*c* so that the weld zone W becomes susceptible to consumption due to action of sparks. More preferably, A/2H is 1.5 or less. H3/H2 is preferably regulated within the range of 0.6 to 1.0. If H3/H2 is less than 0.6, the spark discharge portion 32 becomes excessively thin, resulting in short service life. If H3/H2 is greater than 1.0, the effect of decreasing the amount of the noble metal portion through provision of the projection 4*f* becomes less significant.

A distance H1 from the top surface 4*c* of the spark discharge portion 32 to the upper edge of the weld zone W is preferably 0.2 mm or more. If H1 is less than 0.2 mm, electric discharge is readily generated between the weld zone W and the center electrode 3 so that consumption of the weld zone W is accelerated. More preferably, H1 is 0.25 mm or more.

Figure 20:
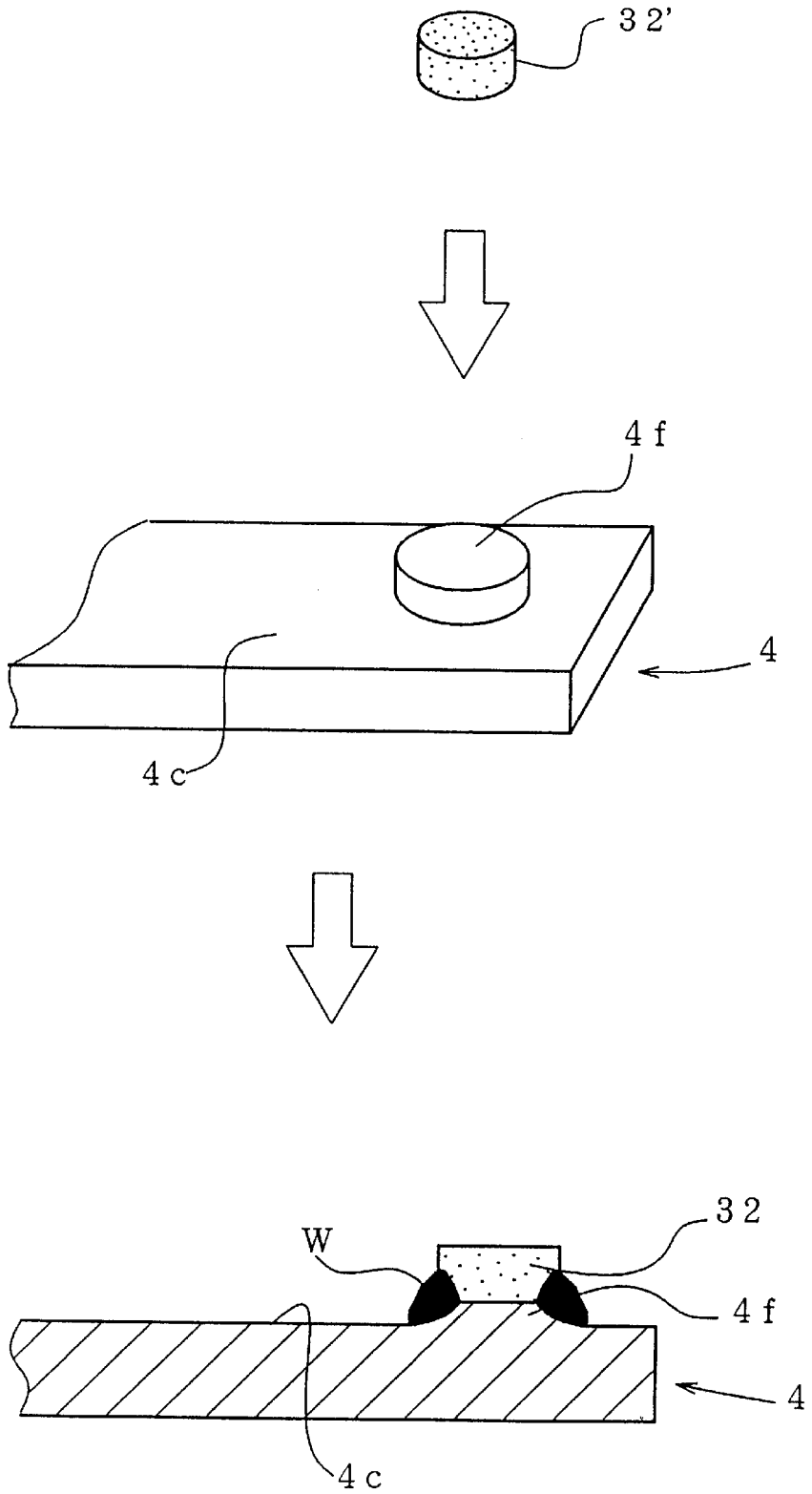
FIG. 20 is an explanatory view showing a method of attaching a projection to the ground electrode of the spark plug of the Reference Invention.
Figure 21:
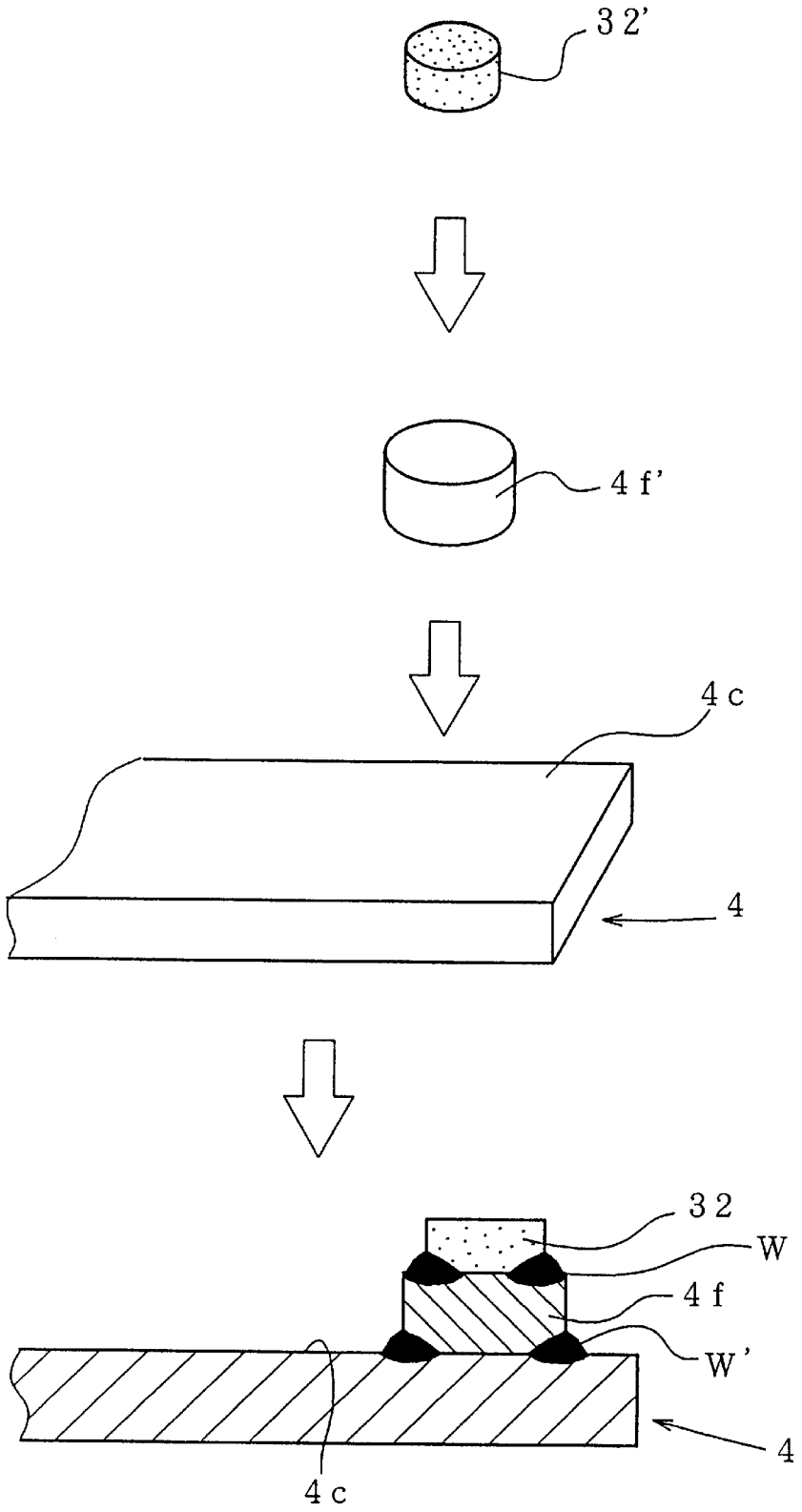
FIG. 21 is an explanatory view showing another method of attaching a projection to the ground electrode of the spark plug of the Reference Invention.

The spark discharge portion 32 can be formed as follows: as shown in FIG. 20, the projection 4*f* is integrally formed on the surface 4*c* of the ground electrode 4 through forging or a like machining process; a noble metal chip 32' is then superposed on the projection; and the projection 4*f* and the noble metal chip 32' are bonded together via a weld portion W through laser welding or a like welding method performed along the border between them. Alternatively, as shown in FIG. 21, a projection-forming member 4*f*' is fixed on the surface 4*c* of the ground electrode 4 via the weld zone W' (through laser welding or resistance welding) so as to form a projection 4*f*; and the noble metal chip 32' is then fixed on top of the projection 4*f* via weld zone W, thereby forming the spark discharge portion 32. In this case, the noble metal chip 32' may be previously bonded to and integrated with the projection-forming member 4*f*', after which the thus-integrated member is fixed to the ground electrode 4.

The spark discharge portions 31 and 32 may be formed from a metallic material containing a noble metal as a main component and having a melting point higher than that of the metallic material forming the ground electrode 4. For example, the spark discharge portions 31 and 32 may be formed of a metallic material including, as a main component, at least one of Pt, Ir, W, and Re. When the metallic material is composed of an Ir alloy, any of the Ir alloys (1) to (5) mentioned above may be used.

Next will be described the examples of the above-mentioned Reference Invention.

Reference Example 1

Predetermined amounts of Ir, Rh, and Pt were mixed and melted, to thereby produce an alloy having a composition of Ir(90 wt. %)—Rh(5 wt. %)—Pt(5 wt. %). The alloy was hot rolled into a plate having a thickness of 0.6 mm through hot working at 700° C. Next, the plate was subjected to hot punching (at 700° C. or more), to thereby obtain disk-shaped chips having a diameter of 0.8 mm and a thickness of 0.6 mm.

The chips were used for forming the spark discharge portions 31 and 32 of the spark plug 102 shown in FIG. 18 according to the procedure shown in FIG. 20 (spark discharge gap g: 1.1 mm, a spark plug of a Reference Example). Both the center electrode 3 and the ground electrode 4 were formed from Ni alloy (Inconel 600). The cross section of the ground electrode 4 had a square shape having a thickness of 1.5 mm and a width of 2.8 mm. In contrast, the projection 4*f* had a columnar shape having an outer diameter of 1.1 mm and a height of 0.3 mm. The noble metal chip 32' was fixed to the projection 4*f* through laser welding. H1, H2, and H3 in FIG. 19 were 0.25 mm, 0.9 mm, and 0.6 mm, respectively. For comparison, another spark plug having the structure shown in FIGS. 16A and 16B was prepared (a spark plug of a Comparative Example). In this spark plug, the depth of the depression 4*d* was 0.5 mm, the height from the surface 4*c* to the top surface 4*e* of the spark discharge portion 32 was 0.1 mm, and the width W1 of the weld zone W was 0.5 mm.

Figure 22:
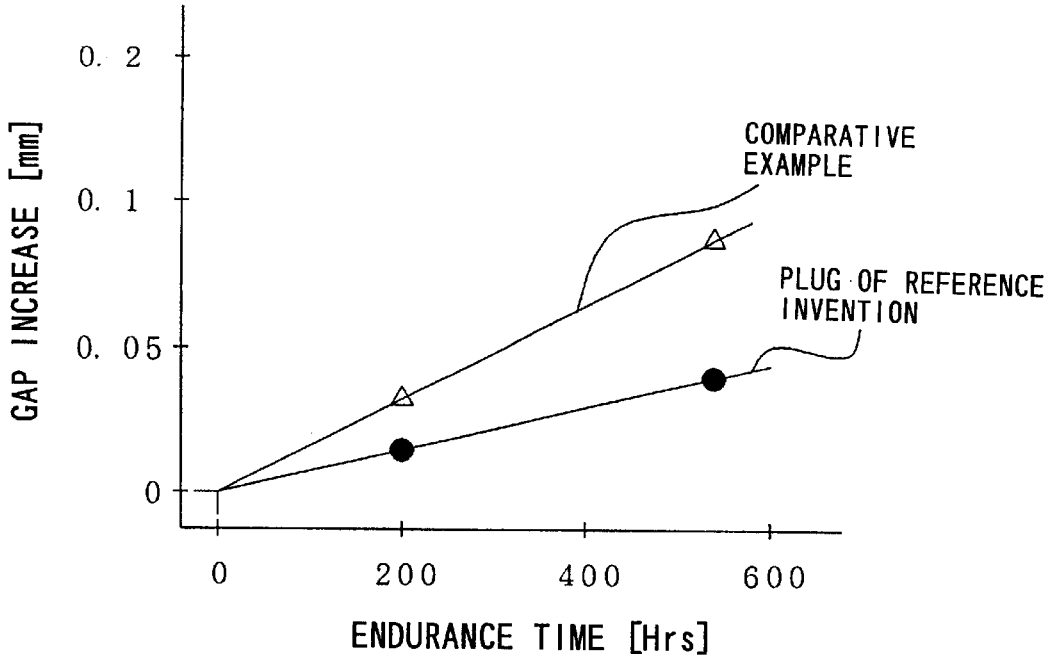
FIG. 22 is a graph showing the results of an experiment on the spark plug of Reference Example 1.

The performance of each of the spark plugs having the thus-formed spark discharge portions 31 and 32 was tested in a 6-cylinder gasoline engine (piston displacement: 2000 cc) under the following conditions: throttle completely open, engine speed 5000 rpm, and 600-hour continuous operation. During the test operation, the increase of the spark discharge gap g was measured every hour. The results are shown in FIG. 22. The results show that the spark plug of the Reference Invention has excellent durability, exhibiting a small increase in spark discharge gap, as compared with the spark plug of the Comparative Example.

Reference Example 2

A variety of noble metal chips having outer diameters of 0.6 to 1.5 mm were cut out from the same plate as used in Reference Example 1, through electric discharge machining. The chips were used to form the spark discharge portions 31 and 32 of the spark plug 102 as shown in FIG. 18 (spark discharge gap g: 1.1 mm). The cross section of the ground electrode 4 had a square shape having a thickness of 1.5 mm and width of 2.8 mm. In contrast, the projection 4*f* had a columnar shape having an outer diameter of 0.8 to 1.7 mm and a height of 0.05 to 2.5 mm. The noble metal chip was fixed to the projection 4*f* through laser welding. The spark plugs were formed such that they had A/H2 values ranging from 0.5 to 2.5.

Figure 23:
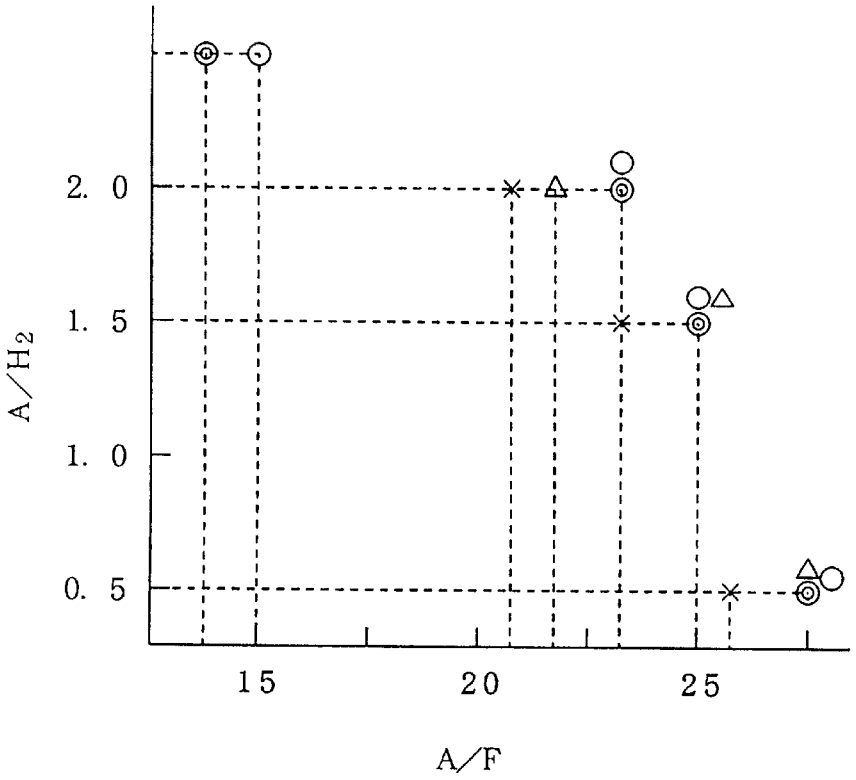
FIG. 23 is a graph showing the results of an experiment on the spark plug of Reference Example 2.

The performance of each of the spark plugs having the spark discharge portions 31 and 32 formed as described above was tested in a 4-cylinder gasoline engine (piston displacement: 1600 cc). The engine was operated in an idling state under no load, while air/fuel ratio (A/F) was gradually increased from 10 to 30. Critical A/F ratio at which the number of times of misfiring reached 10/min was measured. During the measurement, misfiring was considered to have occurred when the concentration of hydrocarbon (HC) contained in exhaust gas became 20% higher than that in a steady state. In this case, a higher critical A/F ratio denotes that the spark plug has better ignition performance for lean mixture. The results are shown in FIG. 23. In this graph, the horizontal axis represent the critical A/F ratio, while the vertical axis represents the ratio A/H2. In addition, values plotted by □ correspond to a spark plug whose chip diameter A was 0.6 mm, values plotted by o correspond to a spark plug whose chip diameter A was 0.8 mm, values plotted by □ correspond to a spark plug whose chip diameter A was 1.2 mm, and values plotted by X correspond to a spark plug whose chip diameter A was 1.5 mm. As shown in this graph, the critical A/F ratio of the spark plug becomes 20 or higher when A/H is 2 or less, regardless of the chip diameter A.

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug comprising:

a center electrode;

an insulator provided outside said center electrode;

a metallic shell provided outside said insulator;

a ground electrode disposed to face said center electrode; and a spark discharge portion fixed on at least one of said center electrode and said ground electrode for defining a spark discharge gap, wherein said spark discharge portion is formed from a noble metal alloy containing a main component element selected from among Ir, Pt, and Rh, and at least one additional component element differing from the main component element; and the additional component element is distributed in said noble metal alloy such that at least one first layer of high concentration is interleaved with at least two second layers of low concentration and said layers extend in a direction perpendicular to the direction of voltage application.

2. A spark plug according to claim 1 wherein said noble metal alloy has a structure in which main component phase regions and additional component phase regions are layered in the direction of voltage application at said spark discharge portion; each of said main component phase regions being mainly formed of the main component element; and each of said additional component phase regions containing the additional component element in an amount greater than that in said main component phase regions, and the main component element in an amount 97% or less that in said main component phase regions.

3. A spark plug according to claim 2 wherein one end of said ground electrode is connected to said metal shell, and the other end of said ground electrode is bent toward said center electrode such that one side surface of said ground electrode faces the tip end surface of said center electrode;

said spark discharge portion is provided on at least one of the tip end surface of said center electrode and the side surface of said ground electrode facing the tip end surface of said center electrode; and said spark discharge portion has a structure in which said main component phase regions having a flat shape and said additional component phase regions having a flat shape are layered in the axial direction of said center electrode.

4. A spark plug according to claim 2 wherein said spark discharge portion is fixed to the tip end surface of said center electrode;

one end of said ground electrode is connected to said metal shell, and the other end of said ground electrode is bent toward said center electrode such that the tip end surface of said ground electrode faces the side surface of said center electrode; and said spark discharge portion has a structure in which said main component phase regions having a flat shape and said additional component phase regions having a flat shape are layered in a direction substantially perpendicular to the axis of said center electrode.

5. A spark plug according to claim 2 wherein each of said main component phase regions and said additional component phase regions are formed into the shape of a plate.

6. A spark plug according to claim 3 wherein each of said main component phase regions and said additional component phase regions are formed into the shape of a plate.

7. A spark plug according to claim 4 wherein each of said main component phase regions and said additional component phase regions are formed into the shape of a plate.

8. A spark plug according to claim 2 wherein each of said main component phase regions and said additional component phase regions are formed into the shape of a rod or a fiber drawn in one direction.

9. A spark plug according to claim 3 wherein each of said main component phase regions and said additional component phase regions are formed into the shape of a rod or a fiber drawn in one direction.

10. A spark plug according to claim 4 wherein each of said main component phase regions and said additional component phase regions are formed into the shape of a rod or a fiber drawn in one direction.

11. A spark plug according to claim 1 wherein said at least one additional component is selected from the group consisting of Rh, Pt, Ir, Pd, Re, Ru, Nb, Os, and W, and is different from the main component element.

12. A spark plug according to claim 11 wherein said noble metal alloy contains Ir as the main component element and at least Rh or Pt as said additional component element.

13. A spark plug according to claim 2 wherein said at least one additional component is selected from the group consisting of Rh, Pt, Ir, Pd, Re, Ru, Nb, Os, and W, and is different from the main component element.

14. A spark plug according to claim 13 wherein said noble metal alloy contains Ir as the main component element and at least Rh or Pt as said additional component element.

15. A spark plug according to claim 3 wherein said at least one additional component is selected from the group consisting of Rh, Pt, Ir, Pd, Re, Ru, Nb, Os, and W, and is different from the main component element.

16. A spark plug according to claim 15 wherein said noble metal alloy contains Ir as the main component element and at least Rh or Pt as said additional component element.

17. A spark plug according to claim 4 wherein said at least one additional component is selected from the group consisting of Rh, Pt, Ir, Pd, Re, Ru, Nb, Os, and W, and is different from the main component element.

18. A spark plug according to claim 17 wherein said noble metal alloy contains Ir as the main component element and at least Rh or Pt as said additional component element.

19. A spark plug according to claim 1 wherein a projection is formed on a surface of said ground electrode facing said center electrode such that said projection projects toward said center electrode and said spark discharge portion is fixed to the tip end surface of said projection.

20. A spark plug according to claim 1 wherein the ratio of A/H2 is 2.0 or less, where A is the diameter of a cross section intersecting the center axis of said projection and H2 is a distance between the surface of said ground electrode facing said center electrode and the tip end surface of said spark discharge portion.

21. A spark plug according to claim 20 wherein the ratio of A/H2 is 1.5 or less.

22. A spark plug according to claim 20 wherein the ratio of H3/H2 is in the range of 0.6 to 1.0, where H3 is the axial thickness of said spark discharge portion.

23. A spark plug according to claim 21 wherein the ratio of H3/H2 is in the range of 0.6 to 1.0, where H3 is the axial thickness of said spark discharge portion.

24. A spark plug according to claim 1 wherein the ratio of A/H2 is 2.0 or less, where A is the diameter of a circle whose area is the same as that of a non-circular cross section intersecting the center axis of said projection and H2 is a distance between the surface of said ground electrode facing said center electrode and the tip end surface of said spark discharge portion.

* * * * *